US010056703B2

(12) United States Patent
Gatnau Navarro et al.

(10) Patent No.: US 10,056,703 B2
(45) Date of Patent: Aug. 21, 2018

(54) TELECOMMUNICATIONS PLUG FOR HIGH DATA RATE APPLICATIONS

(71) Applicant: TE CONNECTIVITY AMP ESPANA S.L.U., Montacada i Reixac, Barcelona (ES)

(72) Inventors: Jorge Gatnau Navarro, Barcelona (ES); Maria Maqueda Gonzalez, Barcelona (ES); Andres Martinez Garcia, Barcelona (ES); Arturo Pachon Munoz, Barcelona (ES); Jose Jaime Sanabra Jansa, Barcelona (ES); Rafael Mateo Ferrus, Barcelona (ES)

(73) Assignee: CommScope Connectivity Spain, S.L., Madrid (ES)

( * ) Notice: Subject to any disclaimer, the term of this patent is extended or adjusted under 35 U.S.C. 154(b) by 0 days.

(21) Appl. No.: 14/905,581

(22) PCT Filed: Jul. 15, 2014

(86) PCT No.: PCT/ES2014/070577
§ 371 (c)(1),
(2) Date: Jan. 15, 2016

(87) PCT Pub. No.: WO2015/007939
PCT Pub. Date: Jan. 22, 2015

(65) Prior Publication Data

US 2016/0164193 A1 Jun. 9, 2016

Related U.S. Application Data

(60) Provisional application No. 61/846,464, filed on Jul. 15, 2013.

(51) Int. Cl.
*H01R 29/00* (2006.01)
*H01R 4/2416* (2018.01)
(Continued)

(52) U.S. Cl.
CPC ..... *H01R 4/2416* (2013.01); *H01R 13/6461* (2013.01); *H01R 13/665* (2013.01);
(Continued)

(58) Field of Classification Search
CPC ..... H01R 23/025; H01R 23/005; H01R 13/6658; H01R 13/658; H05K 1/0228
(Continued)

(56) References Cited

U.S. PATENT DOCUMENTS 5,346,405 A * 9/1994 Mosser, III ..... H01R 13/7032 439/188
6,056,568 A 5/2000 Arnett
(Continued)

FOREIGN PATENT DOCUMENTS

EP 0 971 444 1/2000
EP 1 858 125 A1 11/2007

OTHER PUBLICATIONS

International Search Report and Written Opinion for International Application No. PCT/ES2014/070577 dated Jan. 22, 2015 (18 pages).

*Primary Examiner* — Hien Vu
(74) *Attorney, Agent, or Firm* — Merchant & Gould P.C.

(57) ABSTRACT

A telecommunications plug includes a housing having an insertion portion sized to be received in a telecommunications jack, and a circuit board at least partially disposed within the housing. The circuit board includes a plurality of contacts exposed through the insertion portion to electrically connect to contact springs of the telecommunications jack and a plurality of wire connections receiving wires of a telecommunications cable. The plug further includes a switching mechanism movable relative to the circuit board and configured to switch between first and second positions,
(Continued)

wherein the first and second positions selectably provide capacitive crosstalk between wire pairs within the plug.

12 Claims, 30 Drawing Sheets

(51) Int. Cl.

| | |
|---|---|
| ***H01R 24/64*** | (2011.01) |
| ***H01R 13/6461*** | (2011.01) |
| ***H01R 24/28*** | (2011.01) |
| ***H01R 43/26*** | (2006.01) |
| *H01R 4/2433* | (2018.01) |
| *H01R 13/6466* | (2011.01) |
| *H01R 13/66* | (2006.01) |
| *H01R 13/703* | (2006.01) |

(52) U.S. Cl.
CPC ..... *H01R 24/28* (2013.01); *H01R 24/64* (2013.01); *H01R 29/00* (2013.01); *H01R 43/26* (2013.01); *H01R 4/2433* (2013.01); *H01R 13/6466* (2013.01); *H01R 13/6658* (2013.01); *H01R 13/7039* (2013.01); *H01R 2201/04* (2013.01)

(58) Field of Classification Search
USPC ..... 439/676, 76.1, 393, 941
See application file for complete search history.

(56) References Cited

U.S. PATENT DOCUMENTS

| | | | | |
|---|---|---|---|---|
| 6,059,578 | A | 5/2000 | Arnett | |
| 6,074,256 | A | 6/2000 | Arnett | |
| 6,079,996 | A | 6/2000 | Arnett | |
| 6,156,981 | A | 12/2000 | Ward et al. | |
| 6,162,077 | A * | 12/2000 | Laes | H01R 13/7032 439/188 |
| 6,244,908 | B1 | 6/2001 | Hammond | |
| 6,358,093 | B1 | 3/2002 | Phommachanh | |
| 6,371,780 | B1 | 4/2002 | Aponte et al. | |
| 6,394,853 | B1 * | 5/2002 | Hammond | H01R 13/70 439/676 |
| 6,682,363 | B1 | 1/2004 | Chang | |
| 6,739,892 | B1 | 5/2004 | Belopolsky et al. | |
| 7,381,098 | B2 | 6/2008 | Hammond, Jr. et al. | |
| 7,402,085 | B2 | 7/2008 | Hammond, Jr. et al. | |
| 7,604,515 | B2 * | 10/2009 | Siemon | H01R 13/6463 439/676 |
| 7,611,383 | B1 | 11/2009 | Huang | |
| 7,787,615 | B2 | 8/2010 | Hammond, Jr. et al. | |
| 7,850,492 | B1 | 12/2010 | Straka et al. | |
| 8,113,888 | B2 * | 2/2012 | Carter | H01R 9/03 439/676 |
| 8,151,457 | B2 | 4/2012 | Hammond, Jr. et al. | |
| 8,944,855 | B2 | 2/2015 | Bolouri-Saransar | |
| 2001/0044227 | A1 | 11/2001 | Boutros et al. | |
| 2009/0186532 | A1 | 7/2009 | Goodrich | |
| 2011/0256672 | A1 | 10/2011 | Wada et al. | |
| 2012/0190246 | A1 | 7/2012 | Pepe et al. | |
| 2013/0090011 | A1 | 4/2013 | Bolouri-Saransar et al. | |

* cited by examiner

700

800

900

TELECOMMUNICATIONS PLUG FOR HIGH DATA RATE APPLICATIONS

CROSS-REFERENCE TO RELATED APPLICATION(S)

This application claims priority to U.S. patent application Ser. No. 61/846,464 filed on 15 Jul. 2013, the disclosure of which is incorporated herein by reference in its entirety.

TECHNICAL FIELD

The present application relates generally to a telecommunications plug, and in particular a telecommunications plug useable in high data rate systems.

BACKGROUND

In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

One prevalent type of communication system uses twisted pairs of wires to transmit signals. In twisted pair systems, information such as video, audio, and data are transmitted in the form of balanced signals over a pair of wires. The transmitted signal is defined by the voltage difference between the wires.

Crosstalk can negatively affect signal integrity in twisted pair systems. Crosstalk is unbalanced noise caused by capacitive and/or inductive coupling between wires and a twisted pair system. The effects of crosstalk become more difficult to address with increased signal frequency ranges.

To address the problems of crosstalk, telecommunications connector systems have been designed with configurations adapted to reduce the capacitive coupling effects generated by such connectors. For example, telecommunications jacks, such as RJ-45 often include capacitive crosstalk capacitive elements placed to compensate for crosstalk occurring at a junction between the telecommunications jack and a complementary telecommunications plug. Although such jack-based compensation schemes are acceptable for use across some frequencies of operation (e.g., up to about 500 MHz), for greater frequencies it is difficult to maintain backwards-compatibility to existing jack technologies (i.e., at frequencies below 500 MHz, and in some cases below about 250 MHz). Furthermore, existing plug arrangements are primarily designed for cost reduction and simplicity for modification in the field, rather than to maximize performance.

For these and other reasons, improvements are desirable.

SUMMARY

In accordance with the following disclosure, the above and other issues are addressed by the following:

In a first aspect, a telecommunications plug includes a housing having an insertion portion sized to be received in a telecommunications jack, and a circuit board at least partially disposed within the housing. The circuit board includes a plurality of contacts exposed through the insertion portion to electrically connect to contact springs of the telecommunications jack and a plurality of wire connections receiving wires of a telecommunications cable. The plug further includes a switching mechanism movable relative to the circuit board and configured to switch between first and second positions, wherein the first and second positions selectably provide capacitive crosstalk between wire pairs within the plug.

In a second aspect, a method of selectively providing high frequency data transmission in an RJ-45 plug is disclosed. The method includes inserting an insertion portion of an RJ-45 plug into an RJ-45 jack configured for high frequency data transmission. The method causes engagement of a forward-biased switching mechanism and movement of the switching mechanism from a forward position to a retracted position, the forward position providing capacitive crosstalk between wire pairs within the plug and the retracted position disconnecting the capacitive crosstalk from the wire pairs.

In a third aspect, a telecommunications plug includes a circuit board installed at least partially within an insertion portion, the circuit board including an array of contacts at a first end and a plurality of wire termination contacts mounted thereon. The telecommunications plug further includes a wire connection portion including a chassis, the chassis including a plurality of insulating inserts separated by conductive barriers, each insulating insert having a pair of wire channels positioned therethrough. The wire channels are positioned to receive wires from a telecommunications cable and aligned with the wire termination contacts. The wire termination contacts are positioned at offset positions to reduce an amount of force required to depress the chassis toward the circuit board, and the contacts are positioned in an offset configuration thereby reducing crosstalk generated between the contacts.

DETAILED DESCRIPTION

Figure 1:
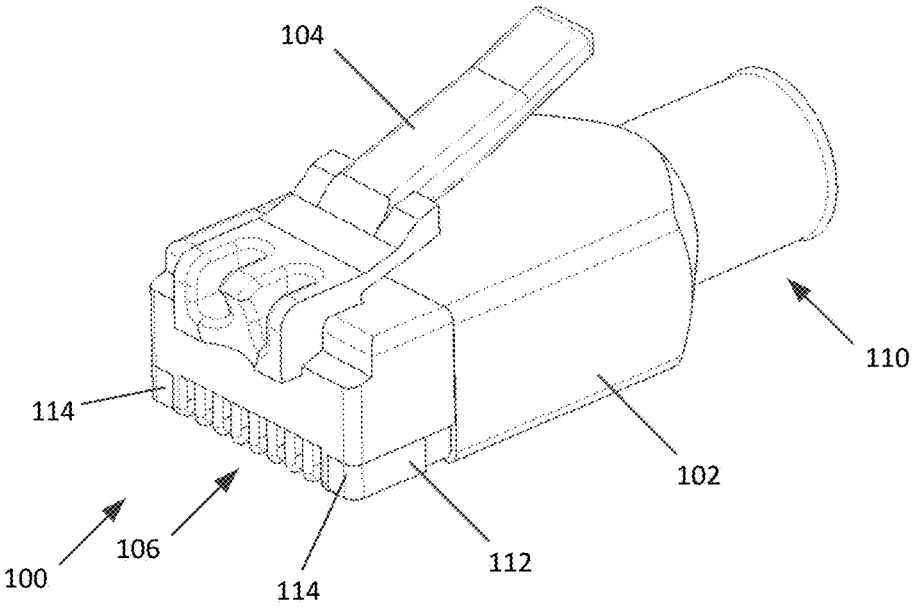
FIG. 1 is a front top perspective view of a telecommunications plug according to an example embodiment of the present disclosure.
Figure 2:
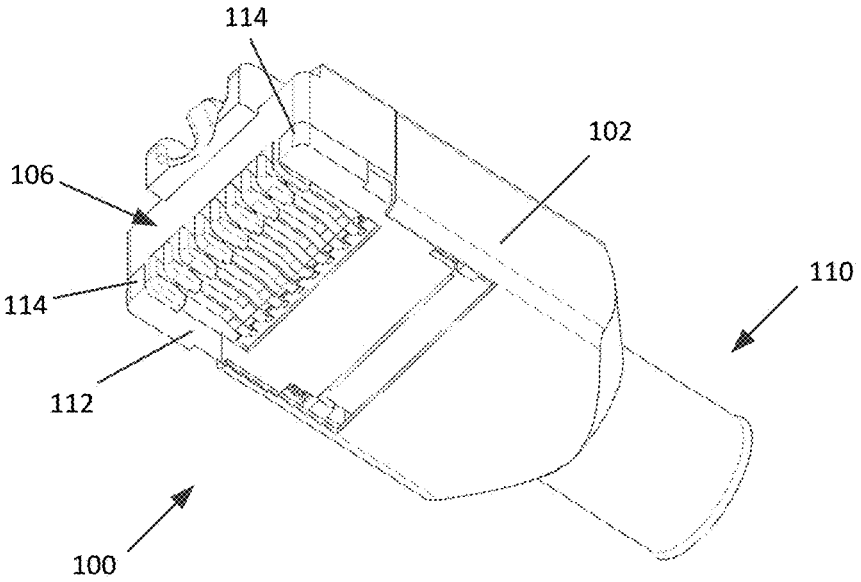
FIG. 2 is a front bottom perspective view of a telecommunications plug according to an example embodiment of the present disclosure.
Figure 3:
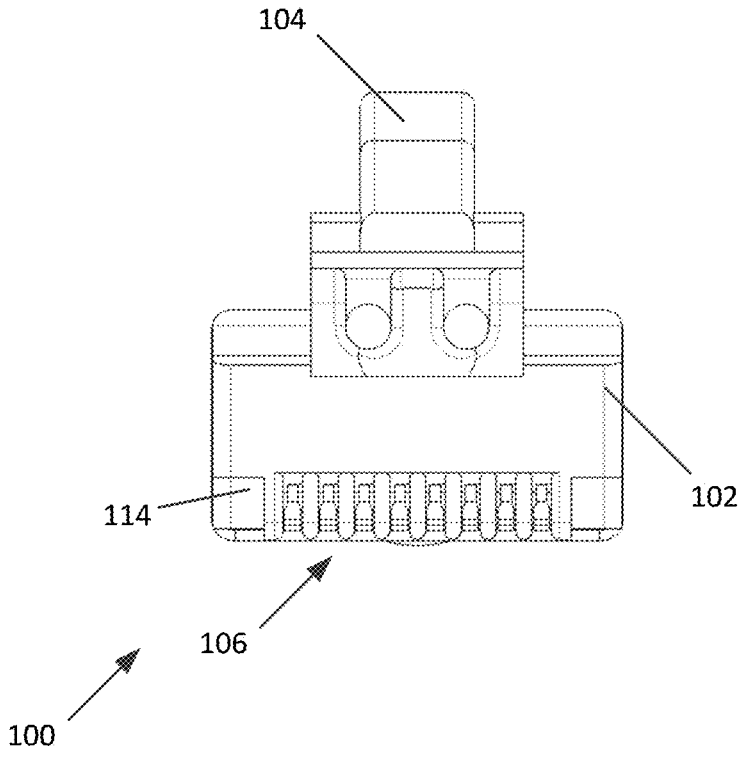
FIG. 3 is a front plan view of a telecommunications plug according to an example embodiment of the present disclosure.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general the present disclosure relates to a telecommunications plug, and in particular a plug that can be used in conjunction with a telecommunications jack to provide improved performance that allows for operation across a wide range of communication frequencies, including frequencies above 500 MHz, and up to and exceeding 1-2 GHz. Accordingly, such a plug, when used in connection with a compatible telecommunications jack, is configured for use in connection with Category-8 communications standards, as are defined (or in the definition process) by the Institute of Electrical and Electronic Engineers.

In general, the present disclosure illustrates a number of alternative embodiments of such telecommunications plugs, such as RJ-45 plugs, with which such high data rate applications can be achieved. In some embodiments, a telecommunications plug is constructed for use with compliant telecommunications jacks, including, for example, a switching jack that is operable in selectable, alternative configurations allowing for either use in applications below and up to 500 MHz, or at frequencies above 500 MHz (e.g., 1-2 GHz for Category-8 applications).

In various embodiments, telecommunications plugs of the present disclosure can be used in a variety of contexts. For example, it may be desirable to use such plugs in both existing and future telecommunications systems. As such, it may be desirable to use such plugs at both sub-500 MHz and 1-2 GHz applications; such plugs are considered to operate under "standard" conditions, and optimized phase or referred to herein as a "Plug with Standard Magnitude and Optimized Phase", or PSMOP, plugs. In alternative embodiments, the plugs may be only useable in 1-2 GHz applications, or "improved" conditions; such plugs are referred to herein as a Plug with Improved Magnitude and Optimized Phase, or "PIMOP" plugs. In still further embodiments, it may be desirable to operate in both frequency ranges, but it may be difficult to use a consistent compensation scheme in a plug across all telecommunications ranges. As such, it may be desirable to use a switching arrangement in the plug, to accommodate uses of the plug across all operational frequency ranges. Such plugs can be configured as a "PIMOP" type plug with switching features. In the embodiments discussed herein, various "PIMOP" type plug features are illustrated.

Referring first to FIGS. 1-7, a general example embodiment of a telecommunications plug 100 is shown, according to an example embodiment. The telecommunications plug 100 includes a body 102 and a latch 104. Along a leading edge of the plug 100, an array of wire contacts 106 is provided, with each of the wire contacts configured to electrically connect to contact springs of a telecommunications jack. In the embodiment shown, eight wire contacts are illustrated; accordingly, the telecommunications plug 100 corresponds, in the embodiment shown, to an RJ-45 jack; however, other formats could be used as well.

It is noted that, in FIGS. 1-7, the array of wire contacts 106 is positioned at a "front" side of the plug 100, corresponding to an end of the plug that is intended to be inserted into a telecommunications jack. One example of a telecommunications jack useable in connection with the plug 100 for either lower-data rate networks (e.g., networks operating at about 500 MHz or lower) or for use in connection with Category-8 systems, is described in U.S. Provisional Patent Application No. 61/789,288, filed on Mar. 15, 2013, the disclosure of which is hereby incorporated by reference in its entirety.

Referring to the plug 100 generally, a cable receiving end 110 of the plug is positioned opposite the array of wire contacts 106. The cable receiving end 110 receives a cable containing twisted pair wiring for interconnection at the plug. Example connection arrangements for such cables within a plug are illustrated in FIGS. 34-47.

Figure 4:
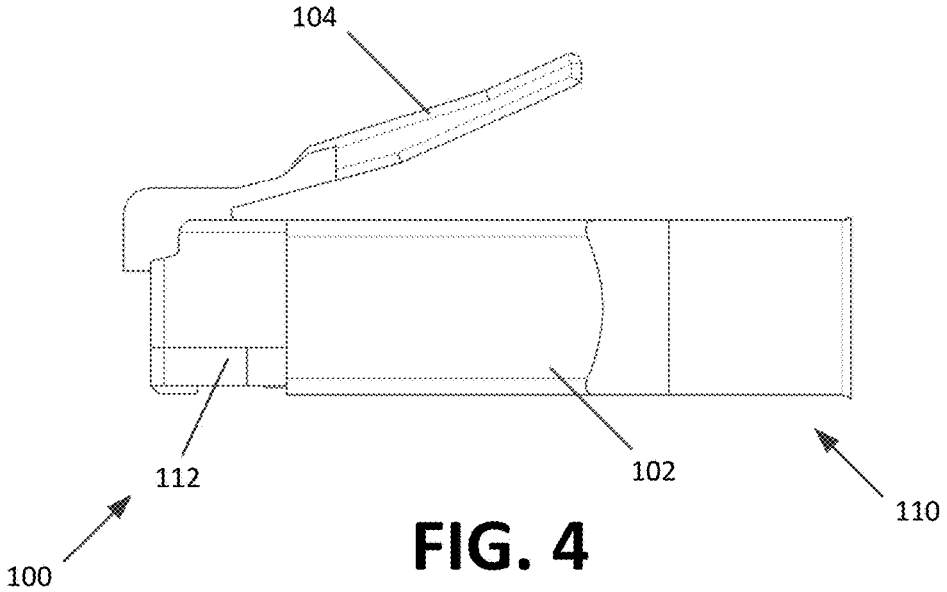
FIG. 4 is a side plan view of a telecommunications plug having a switching component in a first position, according to an example embodiment of the present disclosure.
Figure 5:
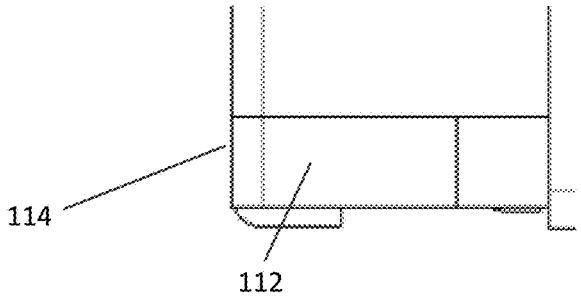
FIG. 5 is a close-up view of the side of the telecommunications plug of FIG. 4 showing the switching component.
Figure 6:
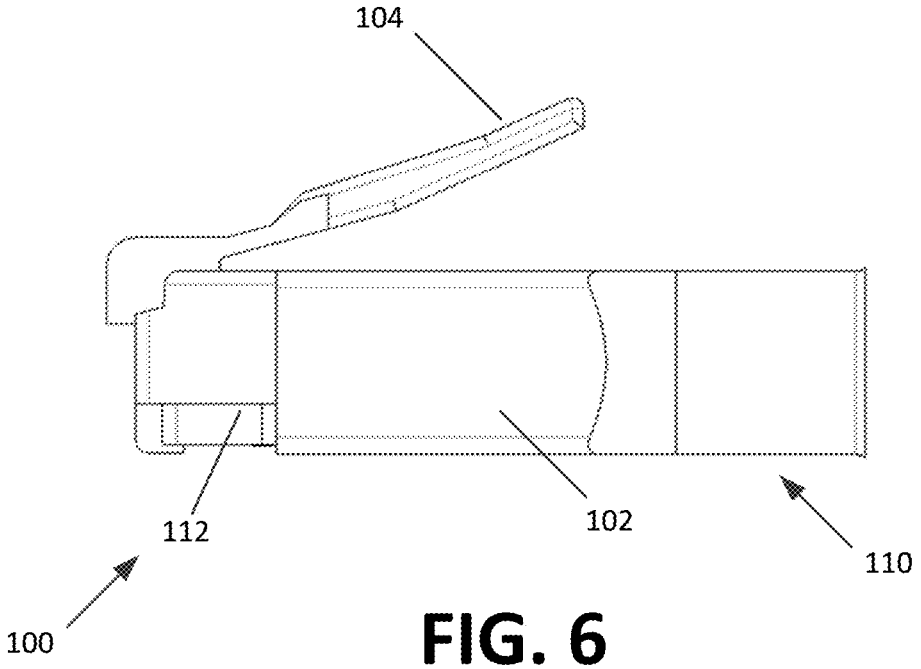
FIG. 6 is a side plan view of a telecommunications plug having a switching component in a second position, according to an example embodiment of the present disclosure.
Figure 7:
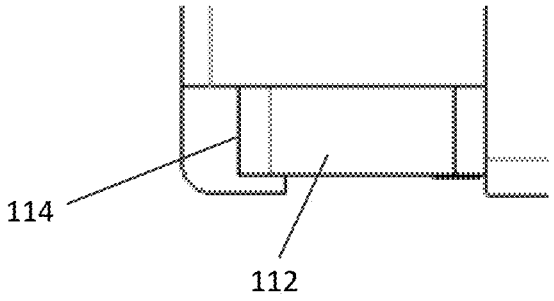
FIG. 7 is a close-up view of the side of the telecommunications plug of FIG. 4 showing the switching component.
Figure 8:
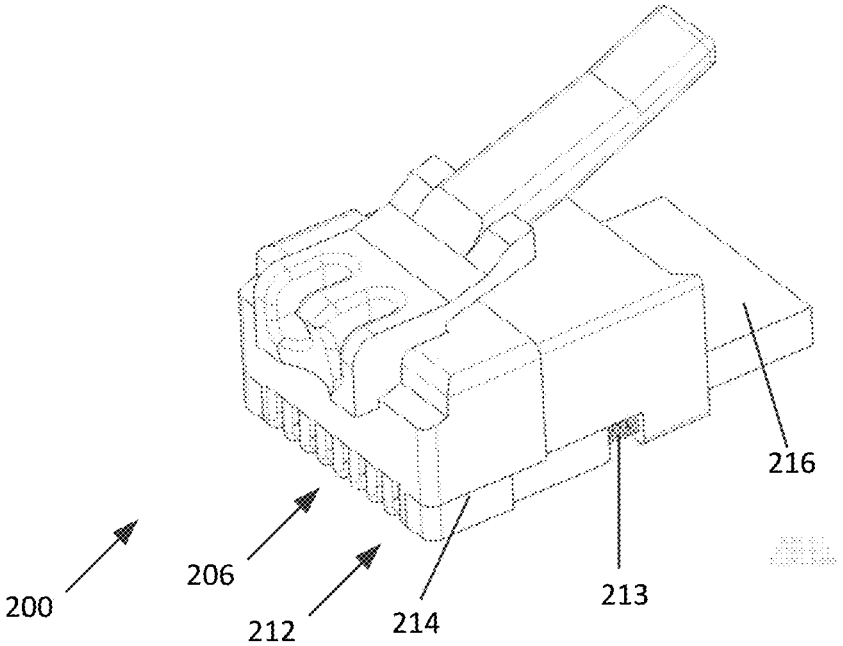
FIG. 8 is a front top perspective view of a telecommunications plug having a switching component in a first position, according to an example embodiment.
Figure 9:
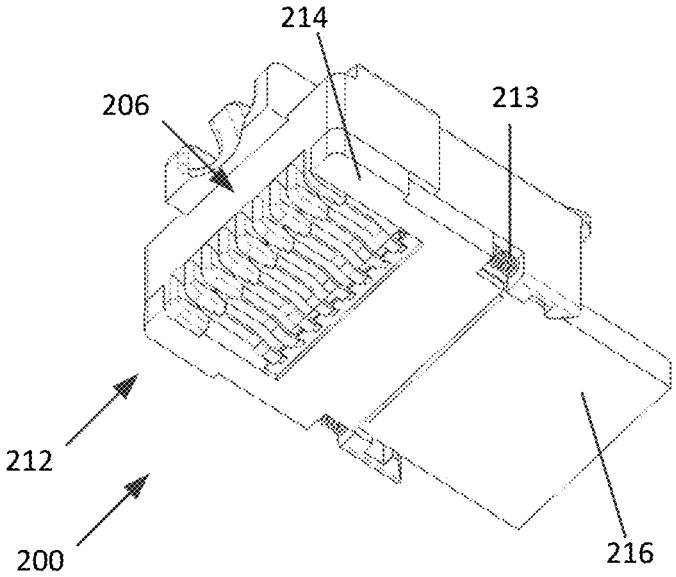
FIG. 9 is a front bottom perspective view of the telecommunications plug of FIG. 8.
Figure 10:
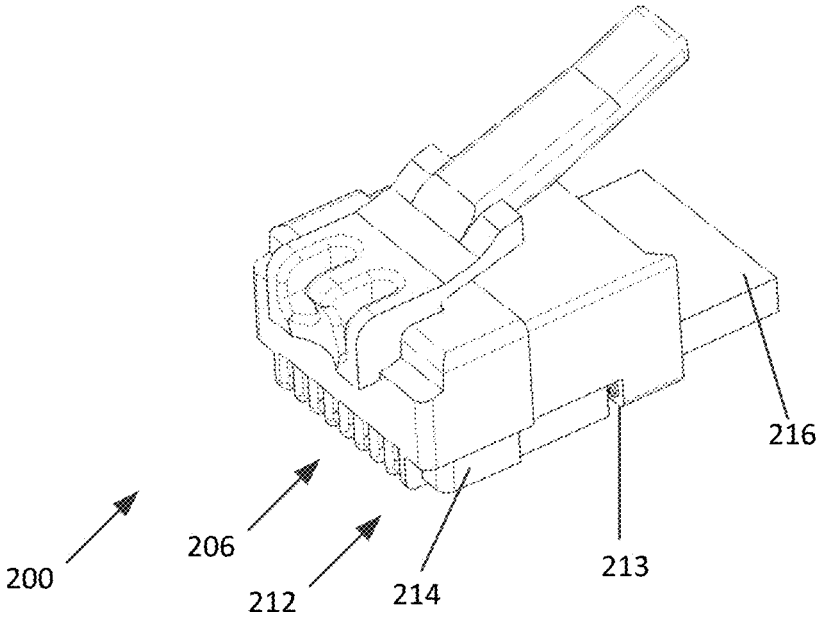
FIG. 10 is a front top perspective view of the telecommunications plug of FIG. 8 with the switching component in a second position.
Figure 11:
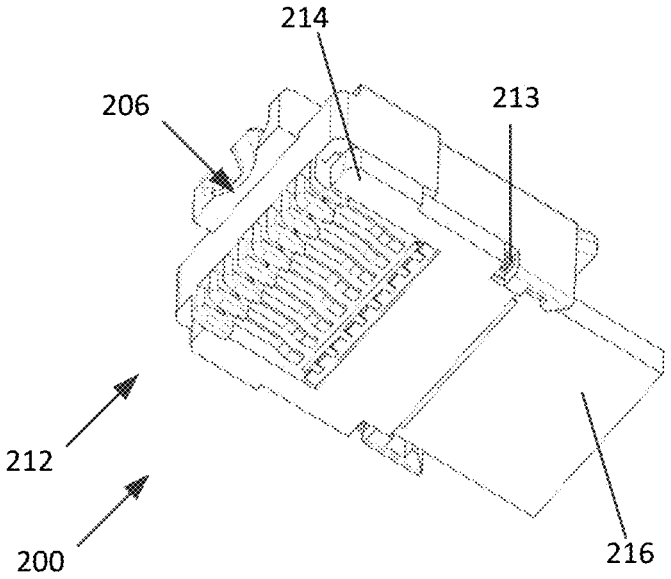
FIG. 11 is a front bottom perspective view of the telecommunications plug of FIG. 8 with the switching component in the second position.
Figure 12:
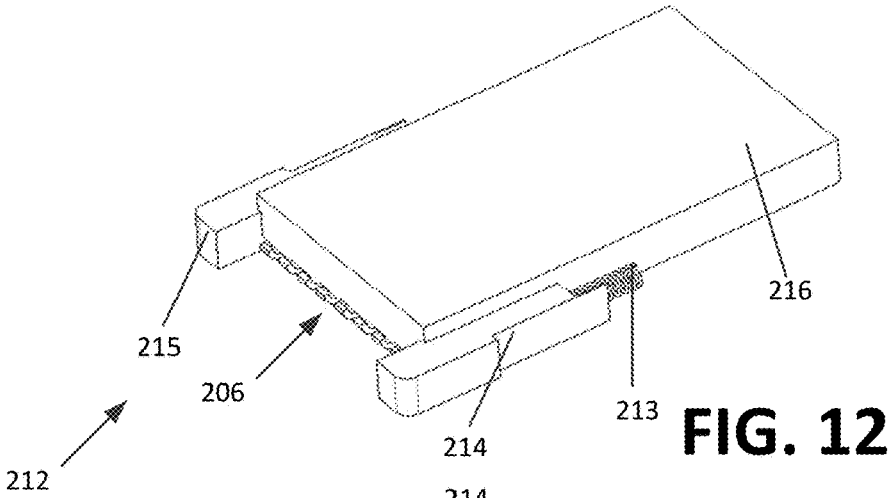
FIG. 12 is a top perspective view of a printed circuit board and associated switching mechanism useable in the telecommunications plug of FIG. 8, in a first position.
Figure 13:
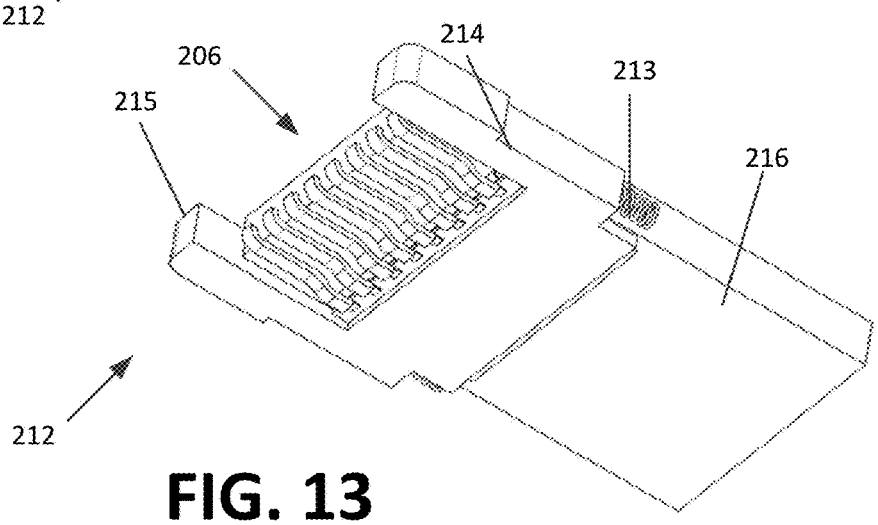
FIG. 13 is a bottom perspective view of the printed circuit board and associated switching mechanism of FIG. 12, in the first position.
Figure 14:
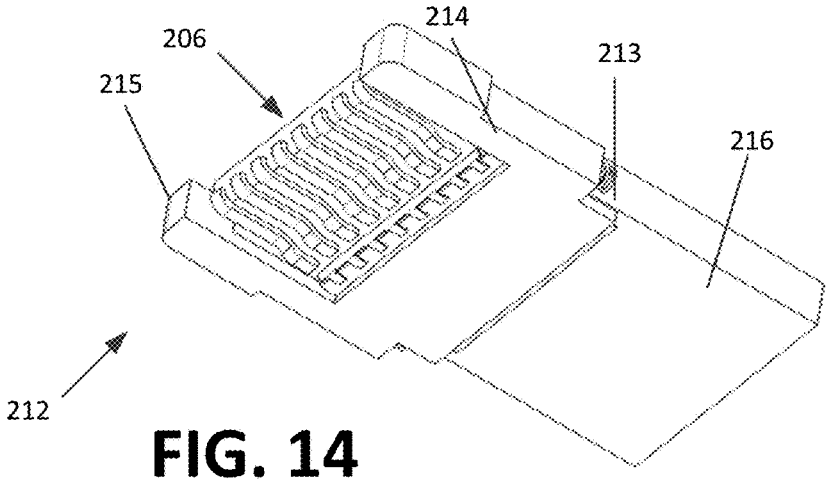
FIG. 14 is a bottom perspective view of the printed circuit board and associated switching mechanism of FIG. 12, in a second position.
Figure 15:
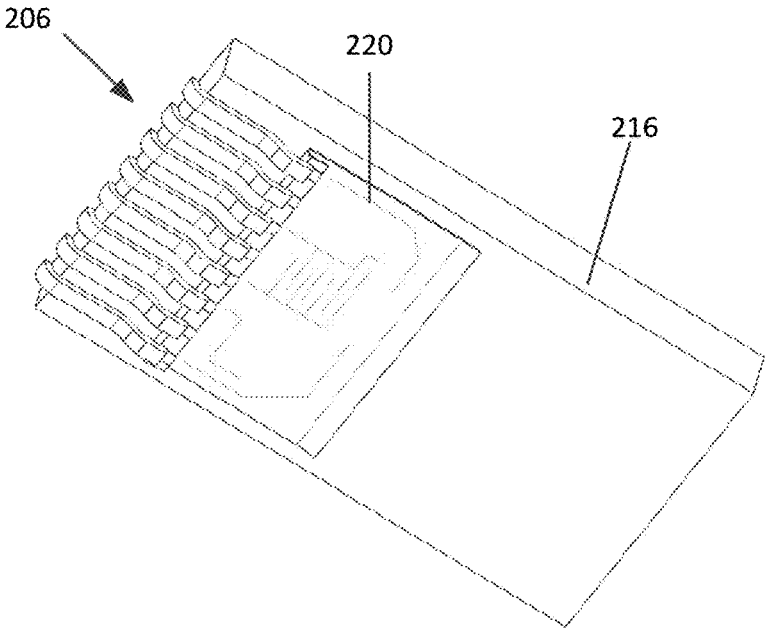
FIG. 15 is a bottom perspective view of a printed circuit board useable in the telecommunications plug of FIG. 8, having a switching mechanism in a first position.
Figure 16:
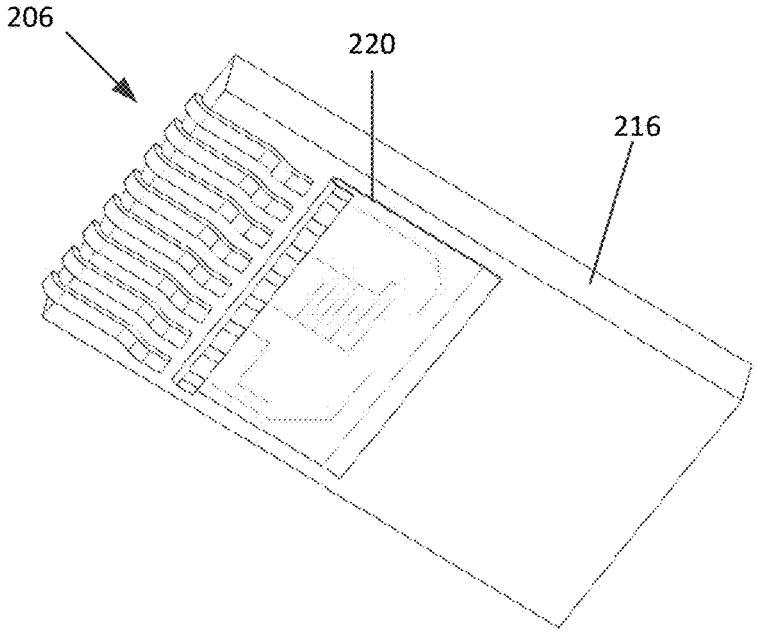
FIG. 16 is a bottom perspective view of a printed circuit board useable in the telecommunications plug of FIG. 8, having a switching mechanism in a second position.
Figure 17:
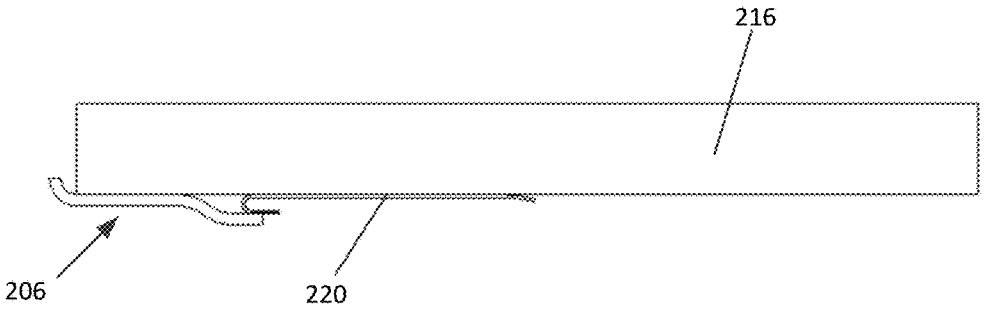
FIG. 17 is a side plan view of the printed circuit board of FIG. 15, having a switching mechanism in a first position.
Figure 18:
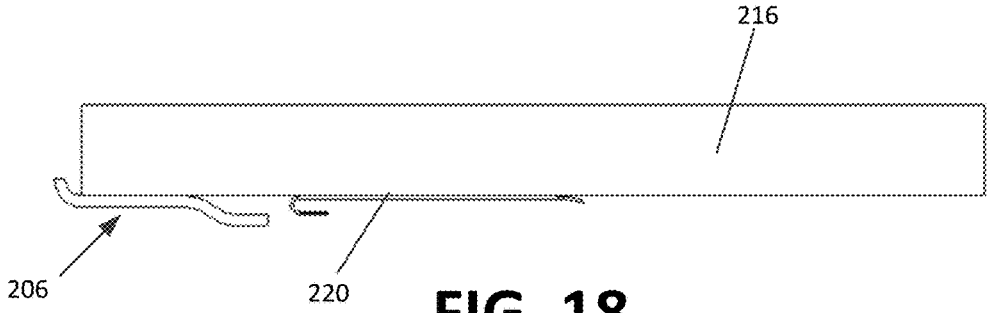
FIG. 18 is a side plan view of the printed circuit board of FIG. 15, having a switching mechanism in a second position.

As specifically illustrated in FIGS. 4-7, in some embodiments, the plug includes a mechanical switching mechanism 112. The mechanical switching mechanism is generally on the front side of the plug 100, and includes one or more surfaces positioned to interface with a corresponding jack, such as described above. In the embodiment shown in FIGS. 4-7, the switching mechanism is engaged by physical contact between a feature within the jack and a front lower corner 114 of the plug. The front lower corner 114 (or both corners, as illustrated herein) is biased in a forward position, and can engage with a switching mechanism within a jack to cause movement of the switching mechanism to an actuated position. However, within a traditional telecommunications jack, the switching mechanism 112 remains unengaged, and remains in the first position (as seen in FIGS. 4-5). Accordingly, in the first position of FIGS. 4-5, the plug can be configured to operate in a manner that is within bounds of acceptability of crosstalk compensation when below 500 MHz, but could change to a different (e.g., improved) level of crosstalk compensation for higher frequencies, and when inserted into a jack compatible with such higher-frequency operation (as in FIGS. 6-7).

Now referring to FIGS. 8-18, one example arrangement for spring biasing and switching of components within a telecommunications jack is shown. In this embodiment, shown as telecommunications plug 200, a switching mechanism 212 includes a slidable chassis 214 having a front portion 215 positioned in a front lower corner of the plug 200. The slidable chassis 214 is spring-biased (e.g., via spring 213) toward a front of the plug 200. As seen best in FIGS. 12-13, the slidable chassis 214 at least partially surrounds a bottom side of a circuit board 216 on which contacts 206 are disposed. By switching the slidable chassis 214 between a first position (seen in FIGS. 8-9, 12, 13) and a second position (seen in FIGS. 10-11, 14) a secondary board 220 can be selectively connected with contacts 206. The secondary board 220 can, in some embodiments, include crosstalk that can selectively be included in-line (i.e., connected between a wire connection on a rear end of the circuit board 216 (discussed below) and contacts 206. In particular, in FIGS. 15 and 17, secondary board 220 connects a crosstalk scheme to the contacts 206, while in FIGS. 16 and 18, the secondary board 220 is disconnected from the contacts 206. In this configuration, the crosstalk scheme included in the secondary board 220 can be used when the plug 200 remains in a first (non-compressed) position, while the crosstalk scheme is disconnected when the plug 200 is in a second, compressed position. Accordingly, the plug 200 is designed such that the additional capacitive crosstalk is only used for backwards-compatibility, i.e., for data transmission frequencies below and up to about 500 MHz, while for increased frequencies, the capacitive crosstalk is removed.

Figure 19:
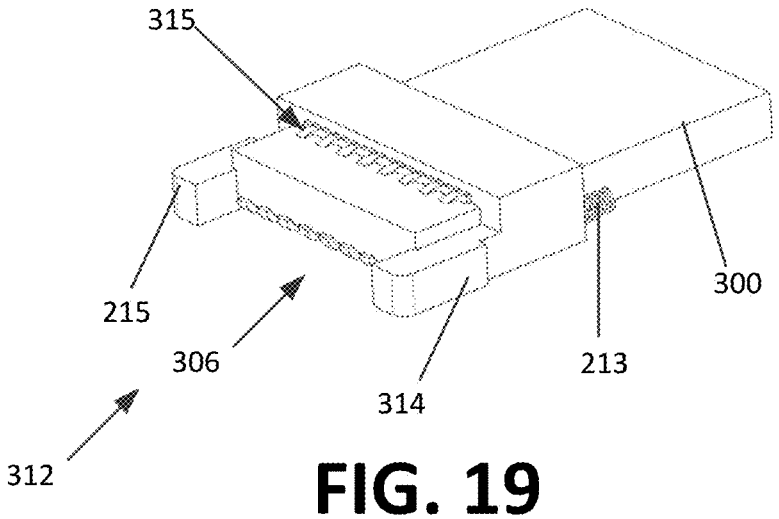
FIG. 19 is a top perspective view of a printed circuit board and associated switching mechanism useable in the plug FIGS. 8-11, in the first position.
Figure 20:
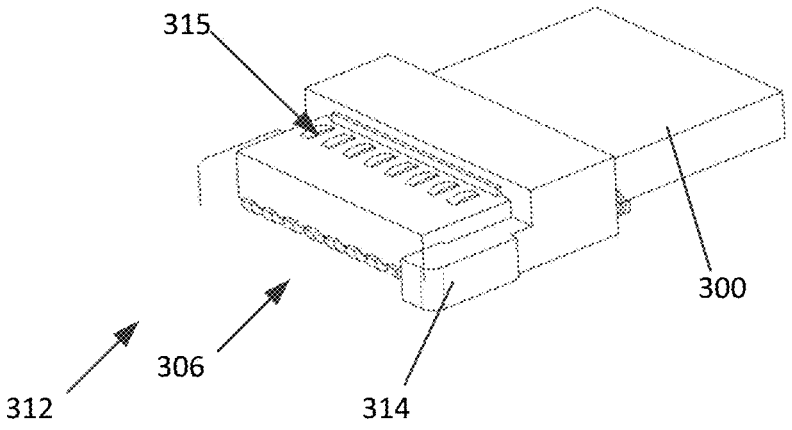
FIG. 20 is a top perspective view of the printed circuit board and associated switching mechanism of FIG. 19, in a second position.

Referring to FIGS. 19-20, an alternative arrangement of a switching mechanism 312 is shown, useable within the plug 200. In this arrangement, the switching mechanism 312 engages the same jacks with a lower front corner engagement location, but rather than being positioned around a bottom surface of a circuit board 216, in this embodiment the slidable chassis 314 extends over a top surface of a circuit board 300. In this arrangement, switching of the slidable chassis 314 between first and second positions (seen in FIGS. 19-20, respectively) causes connection or disconnection of crosstalk from contacts 306, by selectively connecting capacitive elements to contacts 315 on a top surface of the circuit board 300.

Figure 21:
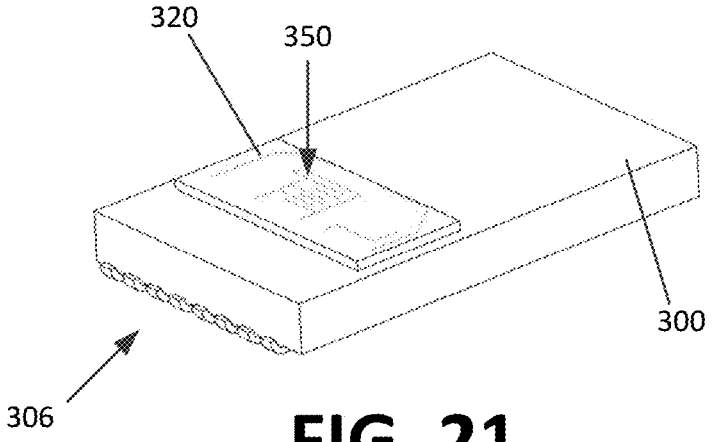
FIG. 21 is a top perspective view of a printed circuit board useable in the telecommunications plug of FIG. 8, having a switching mechanism in a first position.
Figure 22:
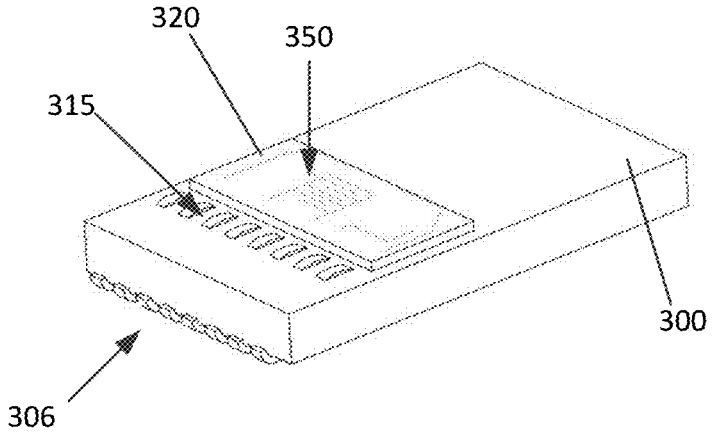
FIG. 22 is a top perspective view of a printed circuit board useable in the telecommunications plug of FIG. 8, having a switching mechanism in a second position.

Referring to FIGS. 21-24, it is noted that the switching mechanism can engage with a variety of different types of switchable crosstalk schemes associated with a circuit board 300. In the arrangement of FIGS. 21-22, connected and disconnected capacitive crosstalk arrangements are shown, respectively, with a secondary circuit board 320 including a crosstalk scheme 350, and positioned to selectively connect to contacts 315 on the top portion of circuit board 300. The contacts 315 are in turn connected to contacts 306 which are positioned for connection to a telecommunications jack including circuit board 300. In this arrangement, the secondary circuit board 320 can be a PCB, a flex circuit board, or some other type of connection arrangement. In a first position (FIG. 21), the secondary circuit board 320 connects to contacts 306 by way of connection to contacts 315, while in a second position (FIG. 22), contacts 315 are exposed and disconnected from the secondary circuit board 320, thereby disconnecting crosstalk scheme 350.

Figure 23:
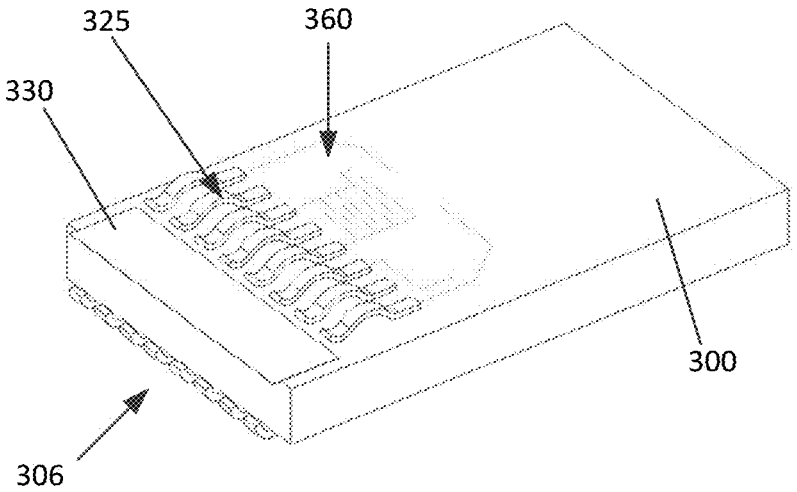
FIG. 23 is a top perspective view of a further embodiment of a printed circuit board useable in the telecommunications plug of FIG. 8, having a switching mechanism in a first position.
Figure 24:
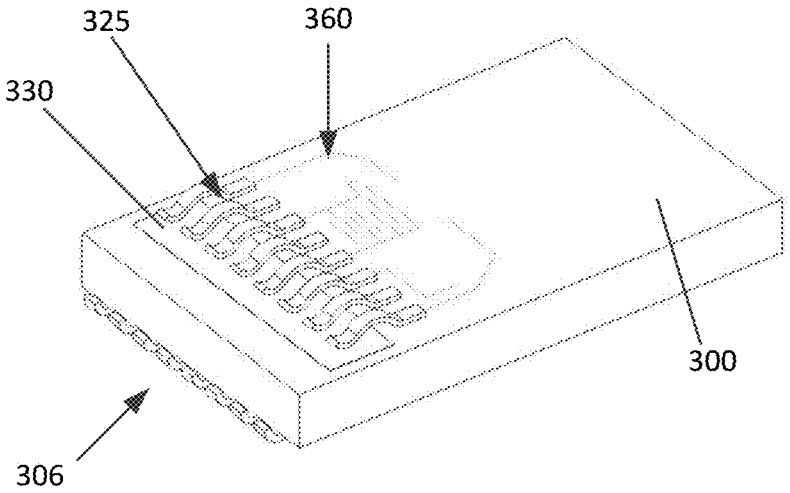
FIG. 24 is a top perspective view of the printed circuit board of FIG. 23, having a switching mechanism in a second position.

In FIGS. 23-24, an alternative crosstalk scheme 360 includes spring contacts 325 positioned on a top surface of the circuit board 300. An insulating layer 330 can be selectably slid from a first position (FIG. 23) apart from the contacts 325 to a second position (FIG. 24) underneath the contacts 325. In the first position, contacts 325 cause connection of a crosstalk scheme 350 to the jack contacts 306; in the second position, contacts 325 are disconnected from circuit traces leading to the contacts 306, thereby removing capacitive crosstalk.

Figure 25:
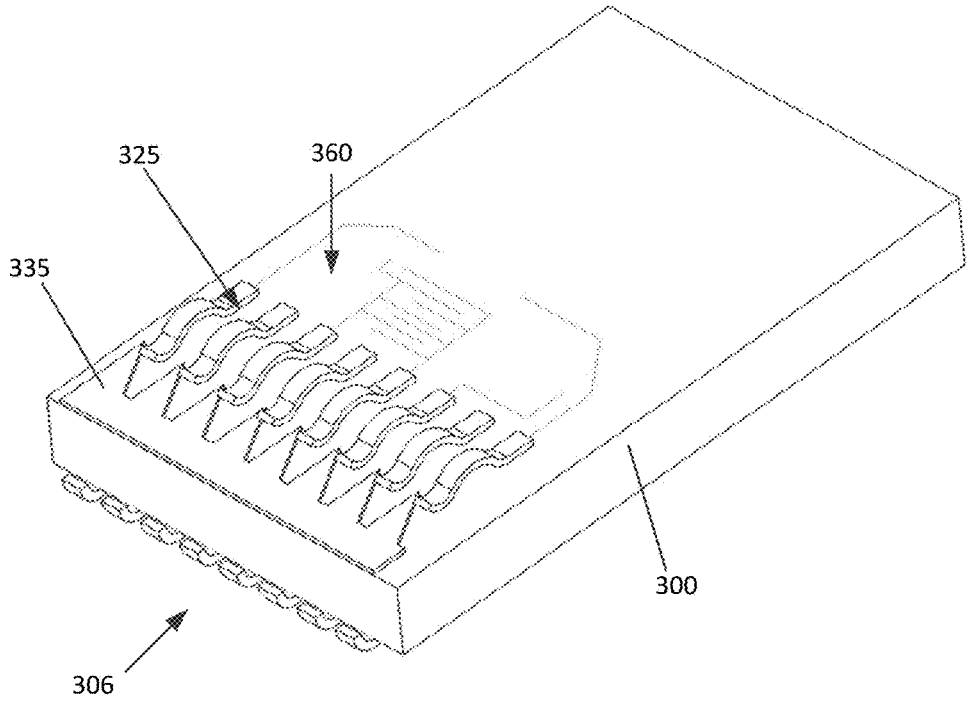
FIG. 25 is a top perspective view of a further embodiment of a printed circuit board useable in the telecommunications plug of FIG. 8, having a switching mechanism in a first position.

FIG. 25 illustrates a further alternative arrangement for selectively connecting or disconnecting crosstalk on a circuit board 300. In this arrangement, a shaped insulating layer 335 could be used, and could be positioned such that either front-back or lateral movement of the insulating layer 335 causes connection/disconnection of contacts 325.

Referring to FIGS. 21-25 generally, it is recognized that a variety of other moving mechanisms could be used, alternatively to the sliding arrangements discussed herein. For example, in some embodiments, rather than sliding in a general front-rear direction, the crosstalk scheme 350 can be electrically connected or disconnected by way of lateral movement of either the secondary circuit board 320 or insulating layer 330. In particular relating to the arrangement of FIGS. 21-22, it is also noted that a vertical separation of the secondary circuit board 320 from the circuit board 300 could cause disconnection of the secondary circuit board 320 from contacts 315; as such, a vertical separation or a flipping motion could be used.

Figure 26:
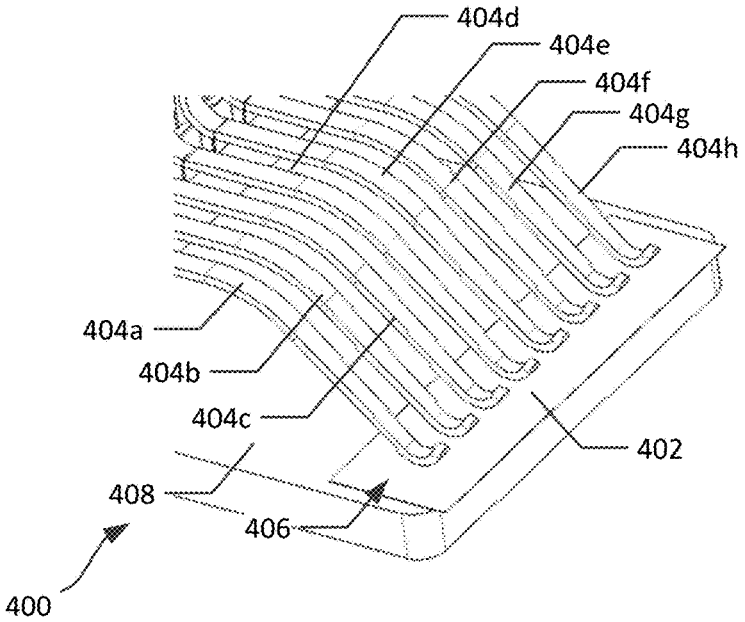
FIG. 26 is a close-up view of portions of contact springs engaging with an insulating pad inserted between the contact springs and a circuit board in a communications jack configured to interconnect with a telecommunications plug as illustrated herein.
Figure 27:
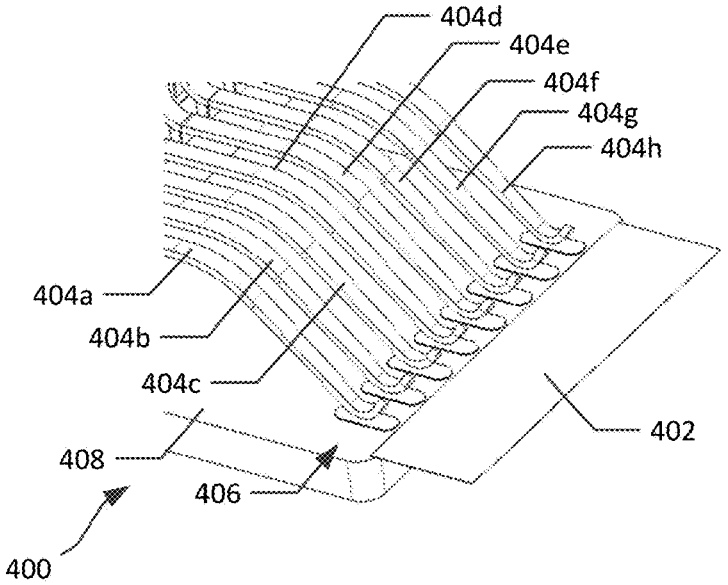
FIG. 27 is a close-up view of portions of contact springs engaging with contact pads of a circuit board, with the insulating pad of FIG. 26 removed.

Referring now to FIGS. 26-27, an example of a switching arrangement 400 useable in a telecommunications jack is illustrated. In the specific example shown, an insulating layer 402 can be selectively inserted between an array of contact springs 404*a-h* and contact pads 406 on a circuit board 408. In this arrangement, insertion of a plug into a jack containing arrangement 400 can, in some embodiments, cause engagement of the insulating layer 402, thereby moving the insulating layer to the position shown in FIG. 26, between the pads 406 and the contact springs 404*a-h*. In the absence of a portion that engages the jack (e.g., a traditional RJ-45 plug) the insulating layer 402 remains unmoved, and therefore electrical connection remains between contact springs 404*a-h* and contact pads 406. Accordingly, various crosstalk arrangements can be provided in the jack for such traditional crosstalk schemes. Example switching arrangements and crosstalk schemes are discussed in further detail in U.S. Provisional Patent Application No. 61/789,288, filed on Mar. 15, 2013, the disclosure of which was previously incorporated by reference in its entirety.

Figure 28:
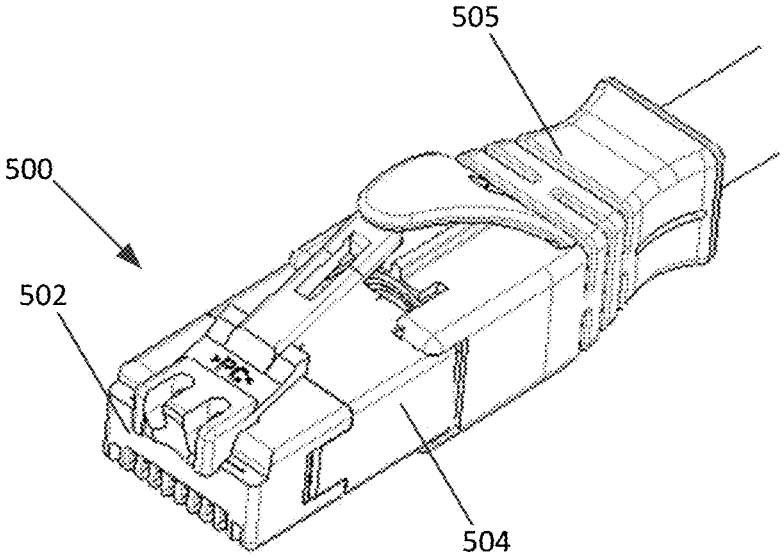
FIG. 28 is a top front perspective view of a further example telecommunications plug assembly, according to an example embodiment.
Figure 29:
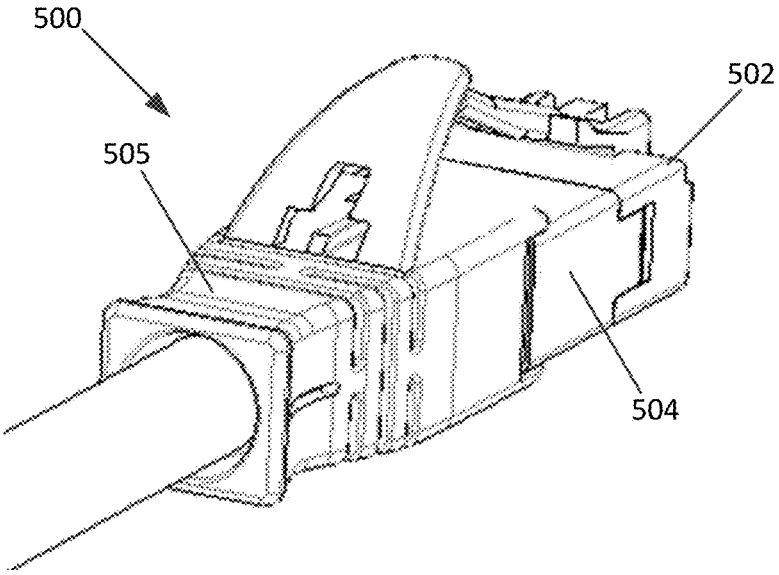
FIG. 29 is a top rear perspective view of the telecommunications plug assembly of FIG. 28.
Figure 30:
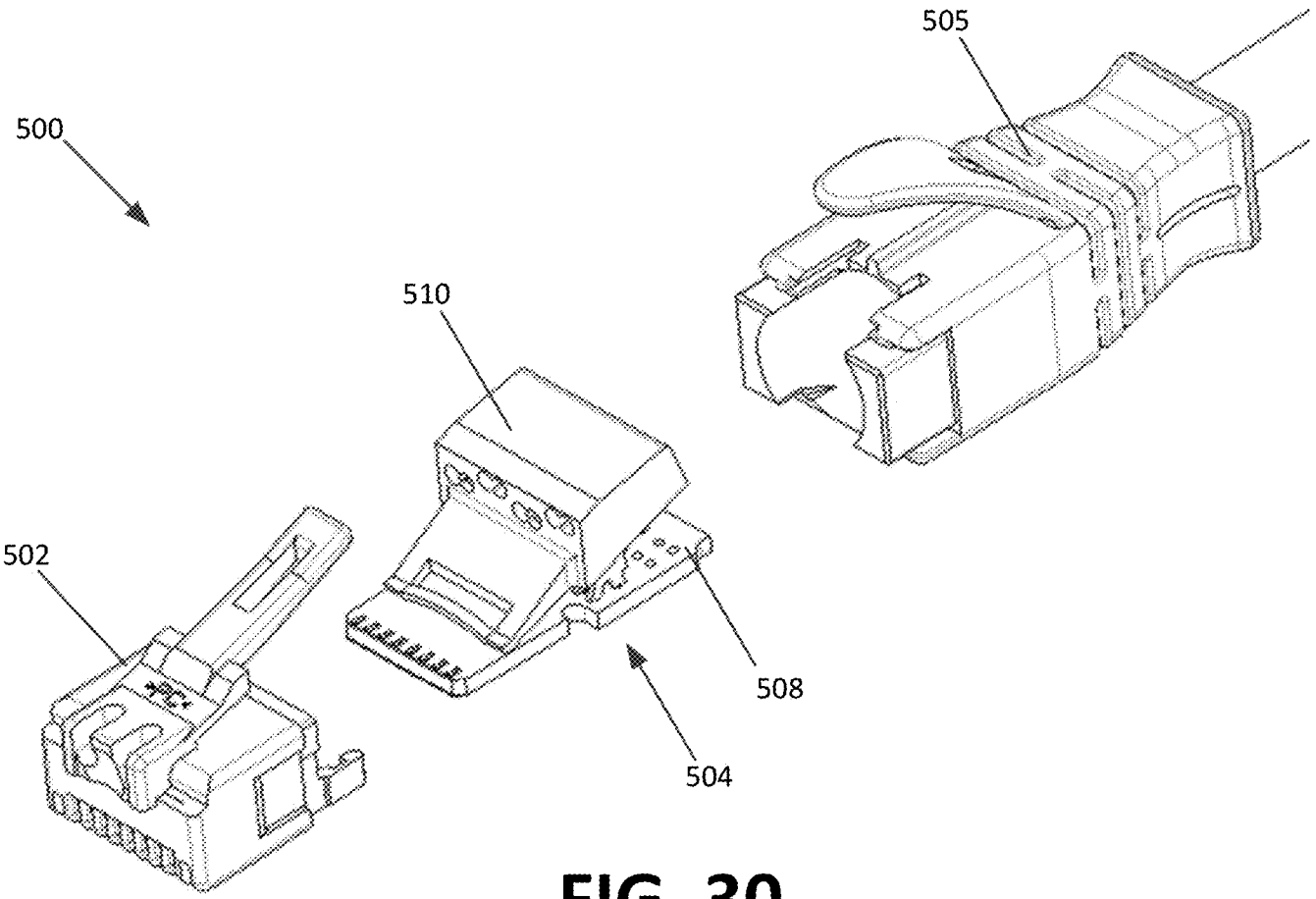
FIG. 30 is an exploded view of the telecommunications plug assembly of FIG. 28.
Figure 31:
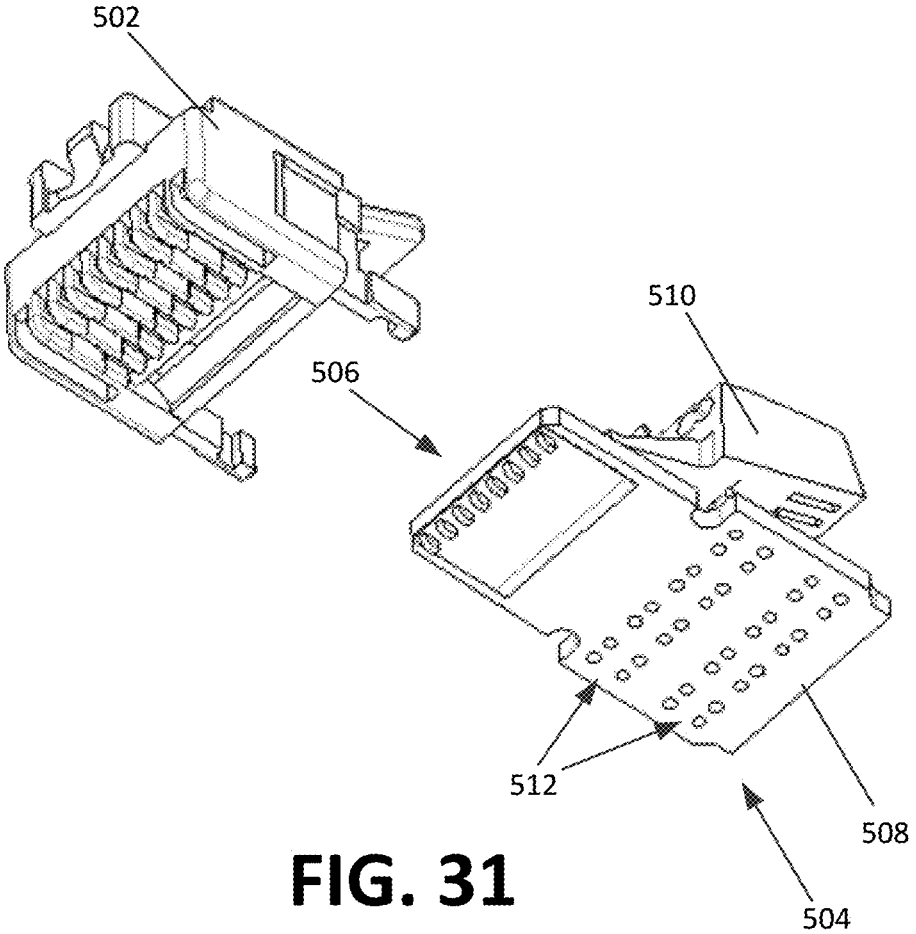
FIG. 31 is a bottom exploded view of a portion of the telecommunications plug assembly of FIG. 28.

It is noted that various other embodiments could be used for a telecommunications plug, beyond those arrangements illustrated in FIGS. 1-25. As seen in FIGS. 28-30 an alternative plug 500 includes a multi-part structure that includes an insertion portion 502, a wire connection portion 504, and a strain relief portion 505. The insertion portion 502 is generally sized to be received in a telecommunications jack, such as an RJ-45 telecommunications jack as discussed in U.S. Provisional Patent Application No. 61/789,288. The wire connection portion 504 receives wires from a telecommunications cable, routed through the strain relief portion 505, for interconnection to contact springs exposed through the insertion portion 502. Referring to FIG. 31, a portion of the plug is illustrated including the insertion portion 502 and the wire connection portion 504 is shown. In this arrangement, the wire connection portion 504 includes an array of contacts 506 positioned on a bottom side of circuit board 508 that extend through the insertion portion 502 for connection to a telecommunications jack. A top side of the circuit board includes an arrangement for connecting to wires of a telecommunications cable, such as insulation displacement contacts or insulation piercing contacts, as discussed in further detail below. In the embodiment shown, a chassis 510 can be used to secure wires to such contacts, thereby connecting wires at a rear side of the circuit board 508 to the contacts 506.

In the embodiment shown in FIG. 31, a plurality of contact positions 512 on the circuit board 508 can be provided, for optional connection of wires to different circuits of the circuit board. For example, rearward contact positions 512 may connect to a first circuit or first crosstalk scheme, while forward contact positions may connect to a second circuit or optional second crosstalk scheme.

Figure 32:
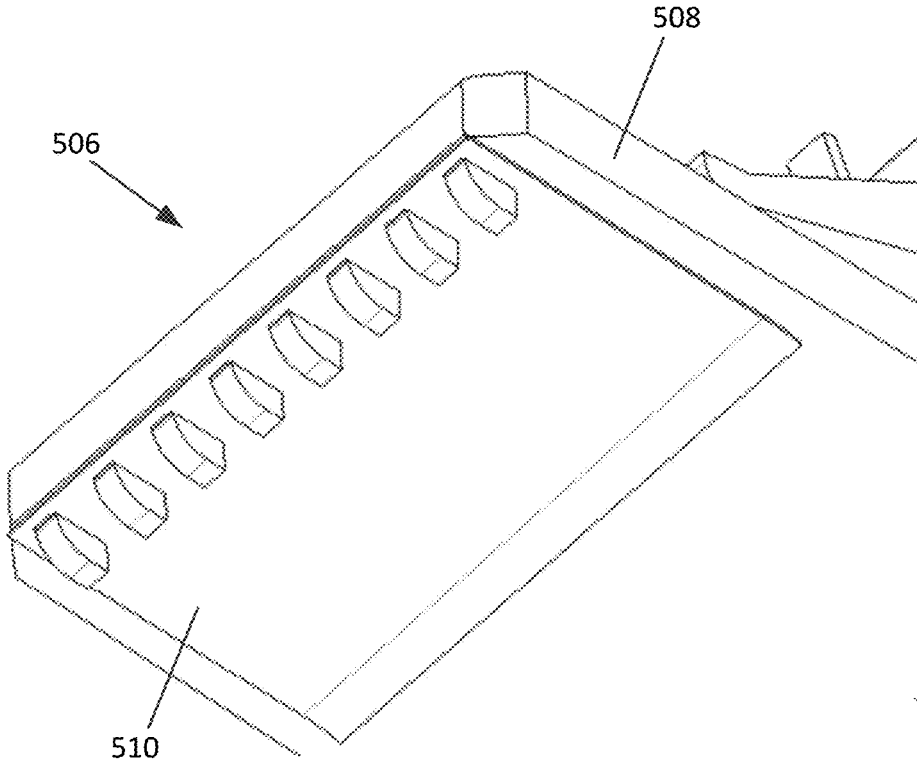
FIG. 32 is a close-up bottom perspective view of plug connection contacts, according to an example embodiment.
Figure 33:
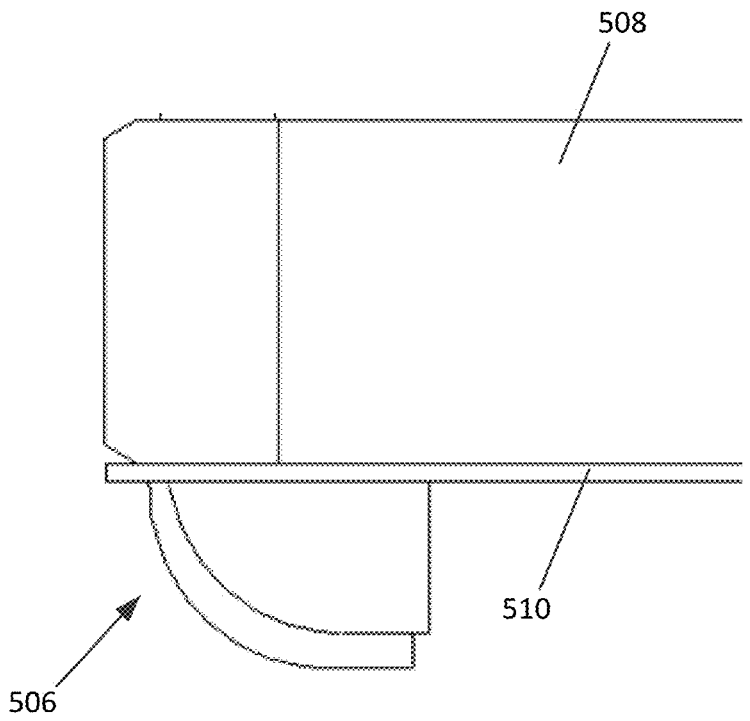
FIG. 33 is a side plan view of plug connection contacts, according to an example embodiment.

As seen in FIGS. 32-33, details of the array of contacts 506 are illustrated. In particular, contacts 506 are positioned along an array at a front edge of the circuit board 508. As seen in FIG. 33, the contacts can be offset from one another, for example at different heights or at different positions relative to the front edge of the circuit board 508. This offset arrangement provides for less capacitive registration between adjacent contacts, and therefore results in a lowering of crosstalk generated at the contacts 506 (a common source of crosstalk occurring at the contacts 506, which form a part of the plug-jack interface when plug 500 is inserted into a corresponding jack). Additionally, as shown, the contacts 506 can be mounted to a secondary circuit board 509, such as a flexible circuit board or other circuit board providing improved signal integrity, and less crosstalk.

Figure 34:
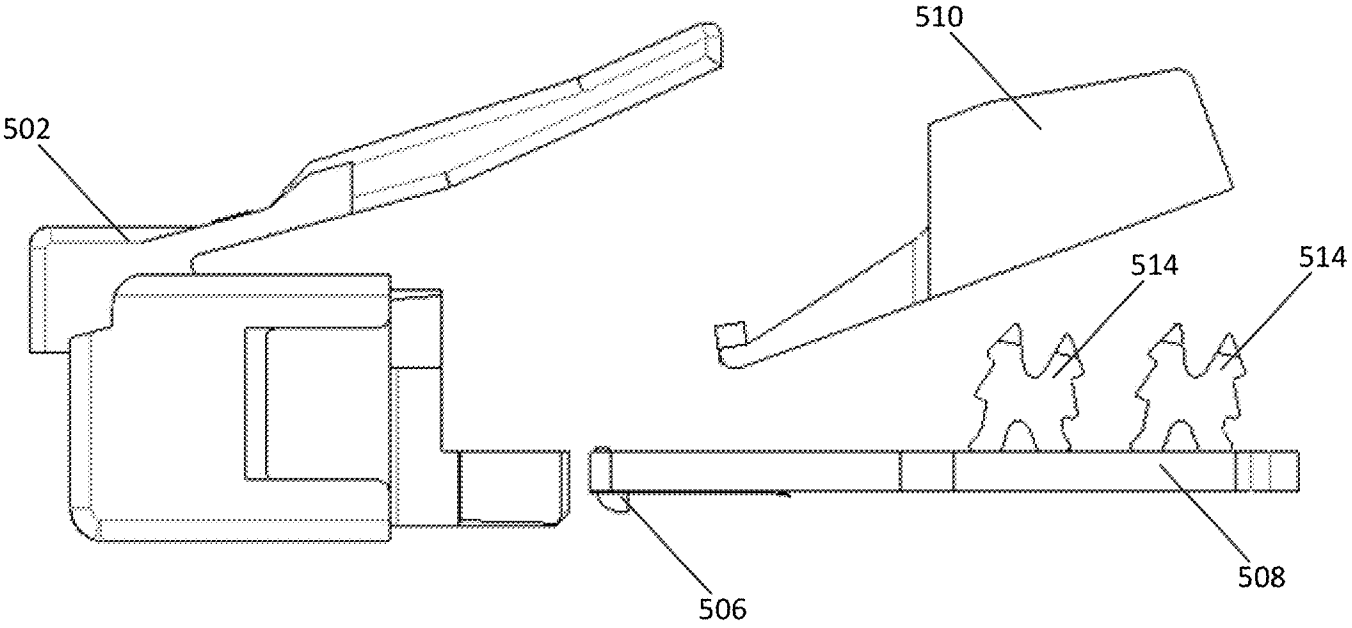
FIG. 34 is a side plan view of a portion of the telecommunications plug assembly of FIG. 28.
Figure 35:
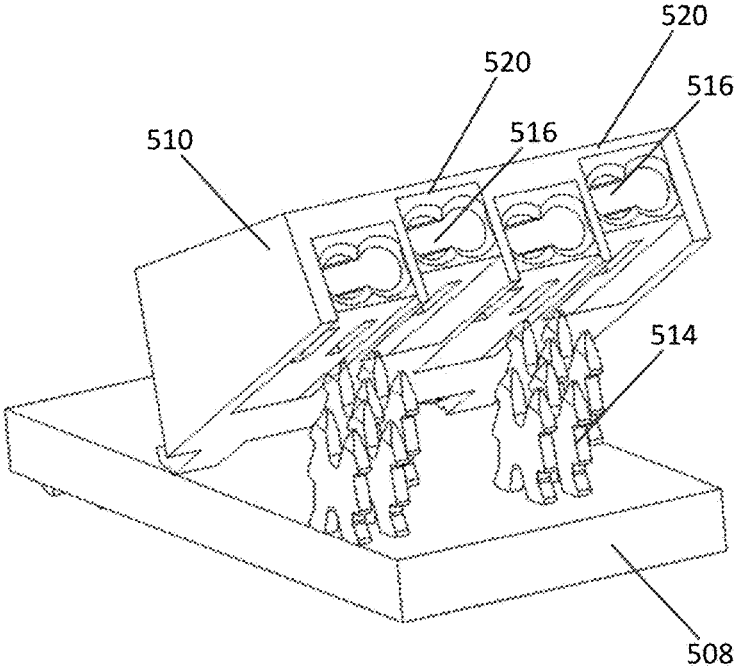
FIG. 35 is a rear perspective view of a portion of the telecommunications plug assembly of FIG. 28 illustrating interconnection of wires of a telecommunications cable.
Figure 36:
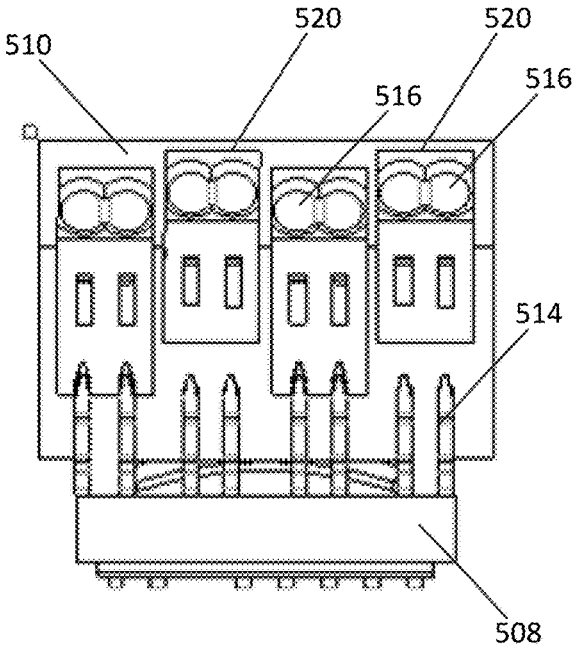
FIG. 36 is a rear plan view of a portion of the telecommunications plug assembly of FIG. 28 illustrating interconnection of wires of a telecommunications cable.

Referring to FIGS. 34-36, additional details regarding connection of wires of a telecommunications cable to the plug 500 are shown. In particular, FIGS. 34-36 illustrate details regarding interconnection of chassis 510 within the plug 500. In particular, chassis 510 is generally shaped to cover an array of insulation piercing contacts 514 positioned at a rear end of the circuit board 508. The chassis 510 includes, as seen in FIGS. 35-36, a plurality of channels 516 through which wire pairs can be inserted. When the wire pairs from a telecommunications cable are inserted into channels 516 and the chassis 510 is depressed onto the insulation piercing contacts 514, to interconnect the wires to routing and crosstalk elements provided on the circuit board 508. In particular, each channel 516 includes two separate slots, one for each wire of a wire pair, and provides alignment of those slots with corresponding insulation piercing contacts 514 (such that two insulation piercing contacts 514 are associated with each channel 516).

In the embodiment shown, the chassis 510 is constructed from a conductive material, such as a metal or a metal- or carbon-impregnated plastic. The chassis 510 includes a plurality of inserts 520 made from an insulating material. The inserts 520 are separated by conductive portions of the chassis 510, thereby electrically isolating each contact pair from adjacent contact pairs, and further reducing crosstalk.

Figure 37:
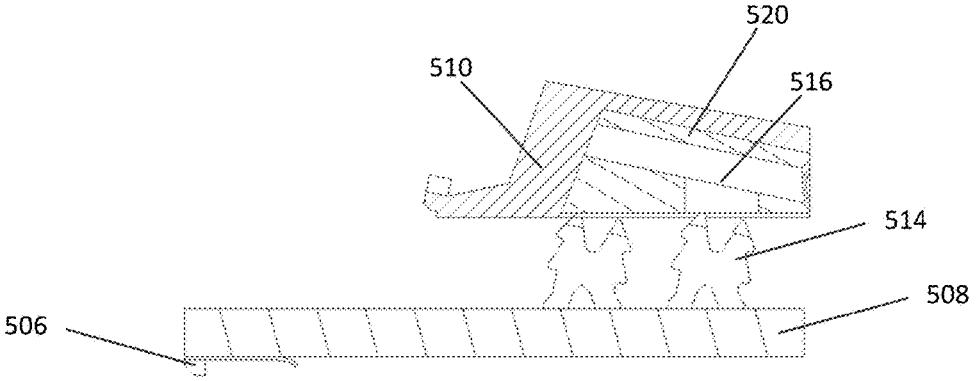
FIG. 37 is a side plan view of a portion of the telecommunications plug assembly of FIG. 28 illustrating structures for interconnection of wires of a telecommunications cable in an open position.
Figure 38:
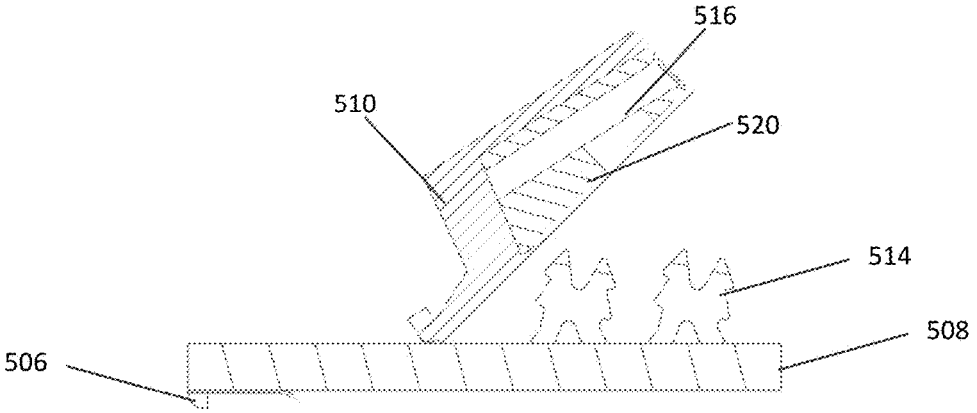
FIG. 38 is a side plan view of the portion of the telecommunications plug assembly of FIG. 37 in an alternative open position.
Figure 39:
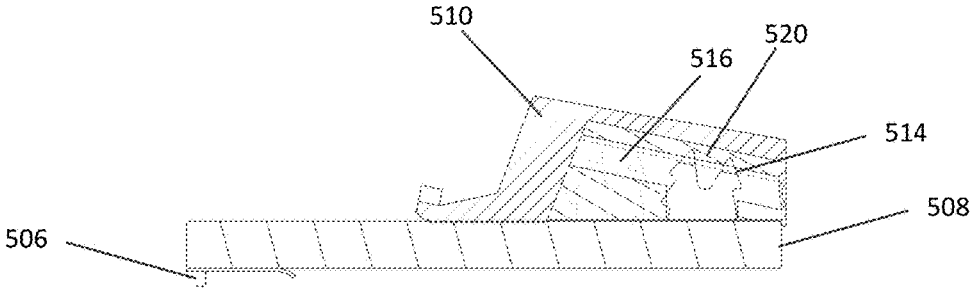
FIG. 39 is a side plan view of the portion of the telecommunications plug assembly of FIG. 37 in a closed position.

As seen in FIGS. 37-39, the chassis 510 can be attached over the insulation piercing contacts 514 in a variety of ways. For example, the chassis can be directly depressed onto the insulation piercing contacts 514, as in FIG. 37, or can be pivoted onto the insulation piercing contacts 514 as seen in FIG. 38. In either case, the contacts will be positioned such that they intersect channels 516, thereby piercing insulation of twisted pair wiring and electrically connecting to that wiring (e.g., as in FIG. 39).

It is noted that, based on the method by which the chassis 510 is depressed on the insulation piercing contacts 514, it may be harder or easier to depress the chassis 510 and pierce the surrounding insulator of each of the twisted pair wires. In such arrangements, a pivoting motion as in FIG. 38 may be preferable, since a leading portion of the chassis can be retained within the insertion portion 502 when adjusting wire connections, thereby avoiding a requirement of separating the insertion portion 502 and the wire connection portion 504 when connecting wires. Additionally, this pivoting avoids the issue of contacting each wire concurrently, since staggered insulation piercing contacts 514 would result in piercing of the insulation at different times for each row of insulation piercing contacts 514. Furthermore, and as best illustrated in FIGS. 35-36, channels 516 can be offset in vertical distance, or otherwise positioned to assist with ease of interconnection of insulation piercing contacts 514 and wires.

Figure 40:
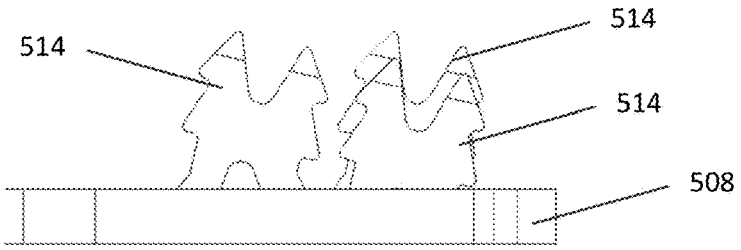
FIG. 40 is a side plan view of a portion of a circuit board and associated insulation piercing contacts useable in a telecommunications plug assembly as discussed herein, according to a first possible embodiment.
Figure 41:
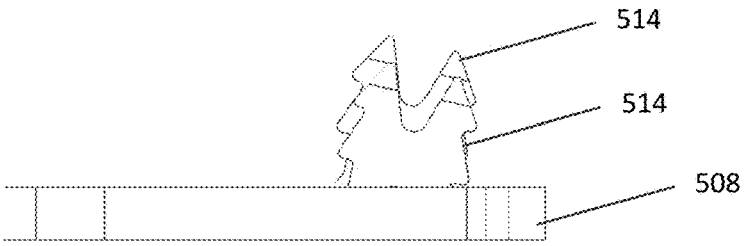
FIG. 41 is a side plan view of a portion of a circuit board and associated insulation piercing contacts useable in a telecommunications plug assembly as discussed herein, according to a second possible embodiment.
Figure 42:
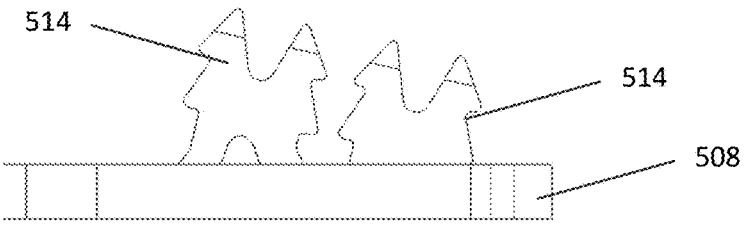
FIG. 42 is a side plan view of a portion of a circuit board and associated insulation piercing contacts useable in a telecommunications plug assembly as discussed herein, according to a third possible embodiment.

In still further embodiments, and as seen in FIGS. 40-42, differences in height and/or position of the insulation piercing contacts 514 can be used, to ensure that each of the insulation piercing contacts 514 pierces insulation of a corresponding wire at a different time, thereby reducing the force required to depress the chassis 510 against the circuit board 508. FIG. 40 illustrates differences in both height and position, with some insulation piercing contacts 514 positioned at different distances from a rear edge of the circuit board 508, while others being positioned at differing heights. In alternative embodiments, only differences in height (as in FIG. 41) or other heights/positions (as in FIG. 42) could be used.

Figure 43:
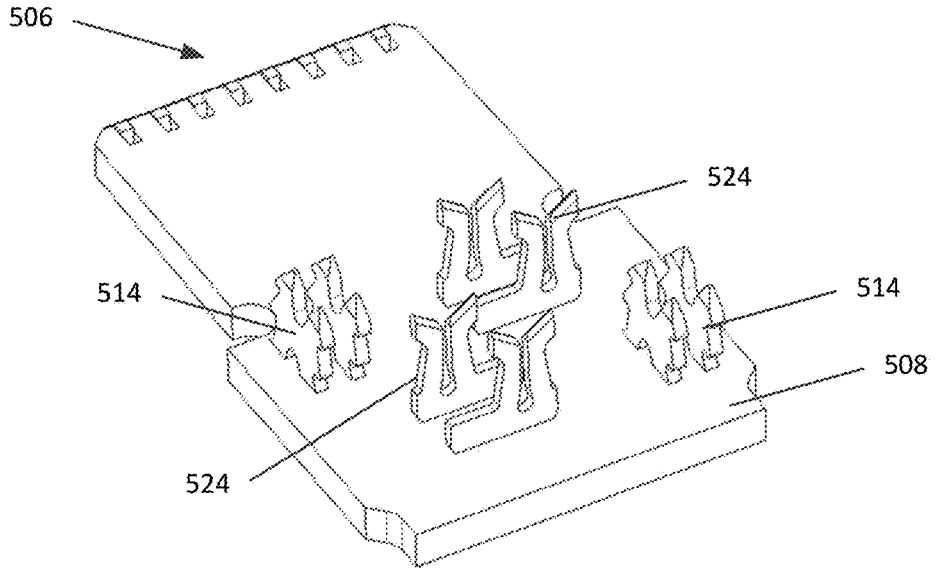
FIG. 43 is a top rear perspective view of a circuit board and associated contact structures useable to connect wires of a telecommunications cable to the circuit board, according to an example embodiment.
Figure 44:
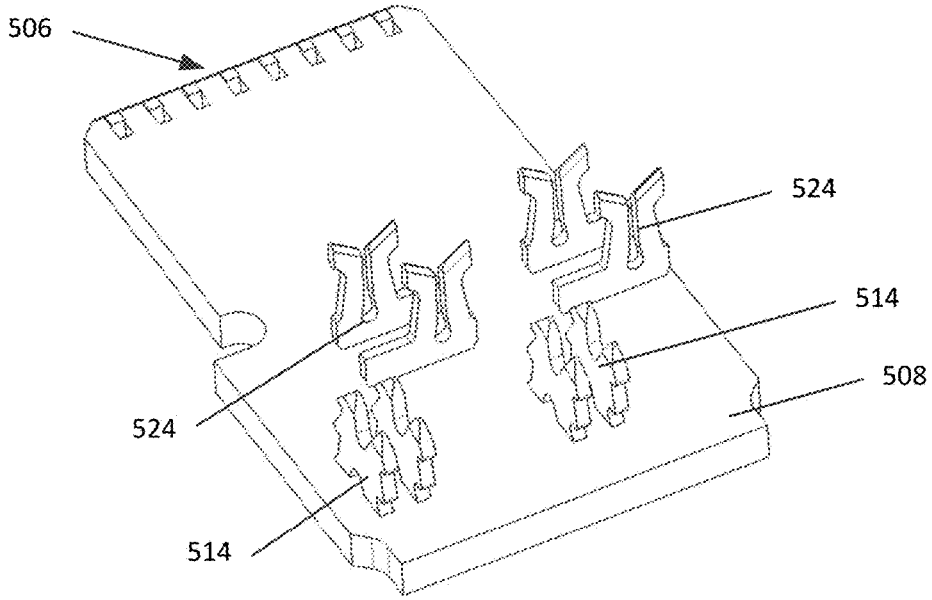
FIG. 44 is a top rear perspective view of a circuit board and associated contact structures useable to connect wires of a telecommunications cable to the circuit board, according to an alternative example embodiment compared to that shown in FIG. 43.
Figure 45:
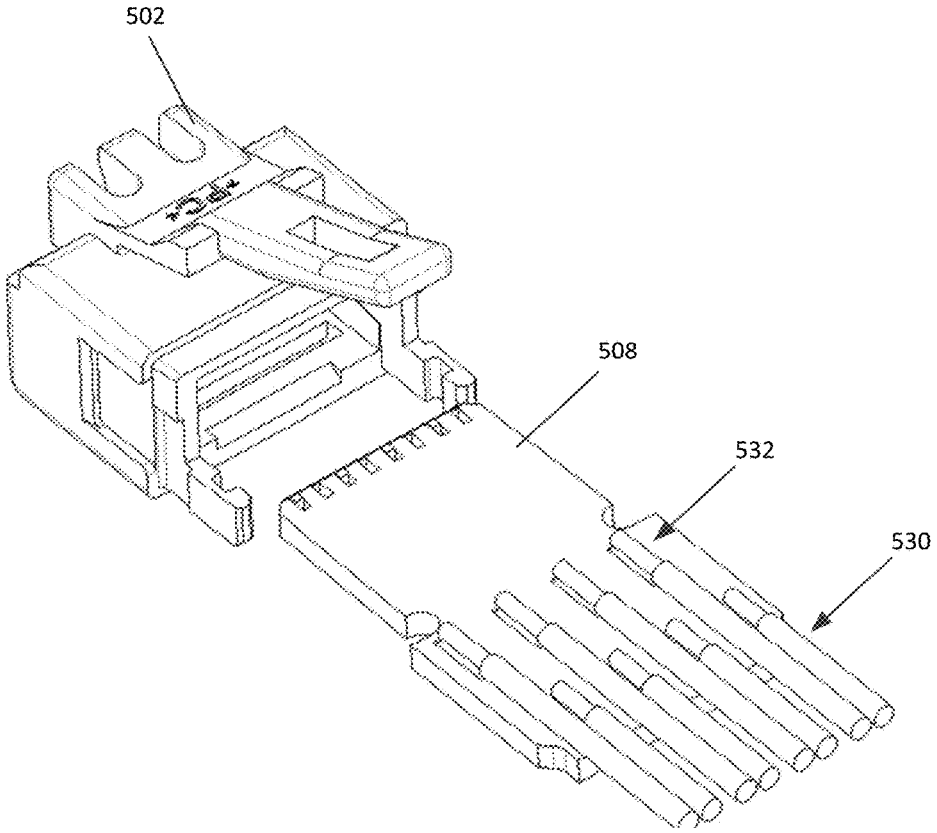
FIG. 45 is a top rear perspective view of a portion of the telecommunications plug assembly utilizing soldered connection to wires of an associated telecommunications cable, according to an example embodiment.
Figure 46:
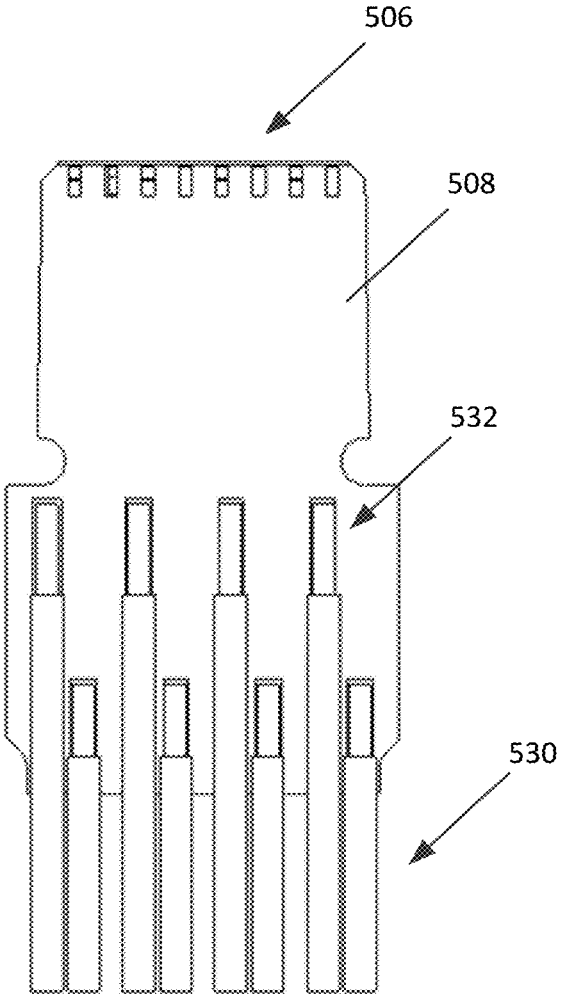
FIG. 46 is a top plan view of the circuit board illustrated in FIG. 45.

FIGS. 43-47 illustrate alternative schemes by which contact springs and wire connections could be implemented. FIGS. 43-44 illustrate mixed use of insulation piercing contacts 514 and insulation displacement contacts 524. Since insulation piercing contacts 514 and insulation displacement contacts 524 are placed at perpendicular orientations to one another, this mixed use of such components reduces crosstalk at the point of connection to wires of a telecommunications cable. Alternatively, to further reduce crosstalk at the point of connection to cables, a direct soldered connection, as in FIGS. 45-46, could be used. In such an arrangement, wires 530 are soldered to contact pads 532, which in turn lead to contacts 506.

Figure 47:
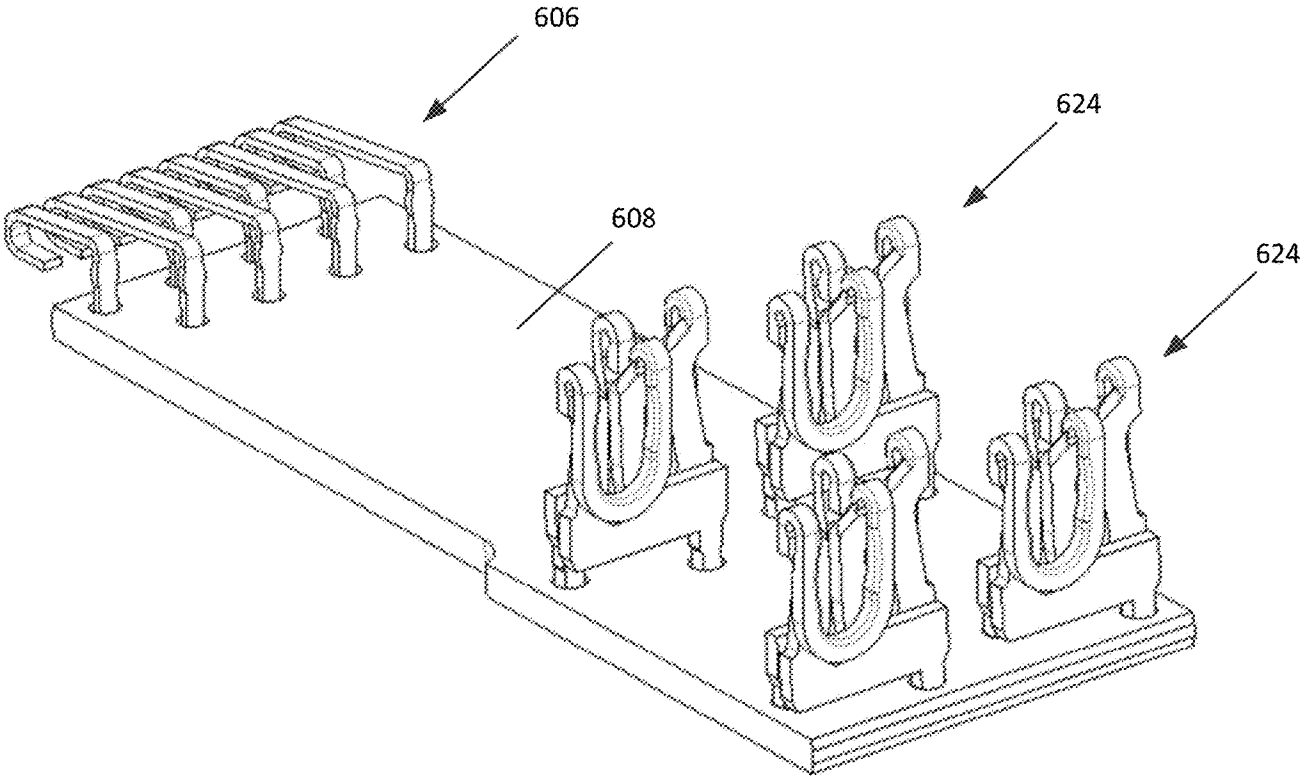
FIG. 47 is a rear perspective view of a further embodiment of a circuit board and associated contact structures useable in a telecommunications plug, according to an example embodiment.

FIG. 47 illustrates a still further example embodiment of a circuit board 608 which could be used in place of circuit board 508 within the plug 500. Circuit board 608 includes contacts 606 which are constructed as bent spring contacts, rather than blade contacts, for connection to spring contacts of a jack. Use of spring contacts, and in particular those mounted at offset positions, also reduces the registration between adjacent contacts, and reduces crosstalk occurring at the contacts 606. Additionally, offset insulation displacement contacts 624 could be used as well, to ensure lower crosstalk between wire pairs.

It is noted that the arrangements shown in FIGS. 28-47 do not include the switching arrangements of FIGS. 1-25; however, it is recognized that such switching arrangements could readily be incorporated into such a plug. Alternatively, the plug 500 could be constructed such that it is useable in connection with high frequency applications, optionally lacking any additional capacitive crosstalk but rather minimizing any crosstalk generated at a plug-jack interface by reducing any crosstalk that may be generated at the plug. Accordingly, FIGS. 31-42 illustrate various techniques for reducing crosstalk generated in the plug; it is recognized that, in some cases, such crosstalk may be desirable, for example to allow the plug to operate at existing frequency ranges. Accordingly, in some embodiments, and as discussed above, the telecommunications plug may be used with telecommunications jacks across a variety of frequency ranges, or may include switching characteristics to allow for operation at both low and high frequencies.

Figure 48:
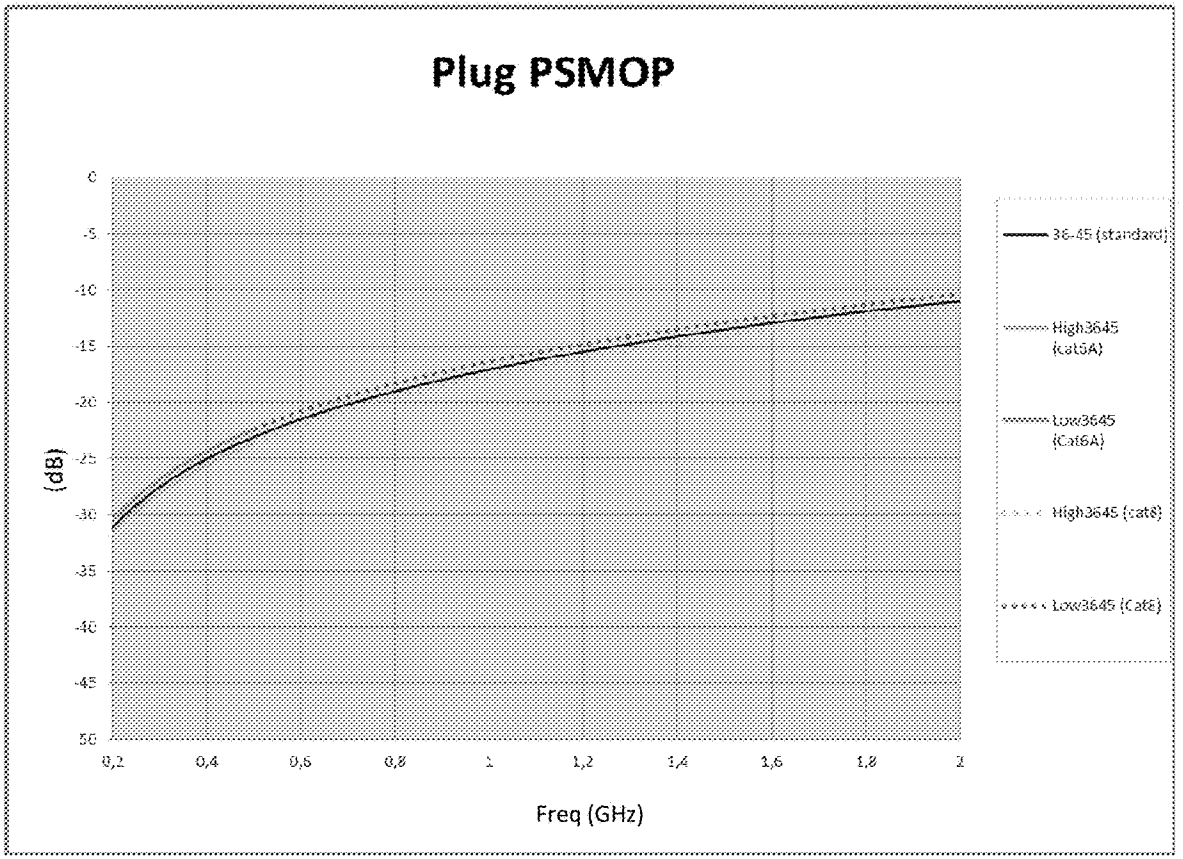
FIG. 48 is a chart showing crosstalk performance of a telecommunications plug constructed for use in connection with high data rate telecommunications systems as well as backwards compatible with existing telecommunications systems, according to aspects of the present disclosure.
Figure 49:
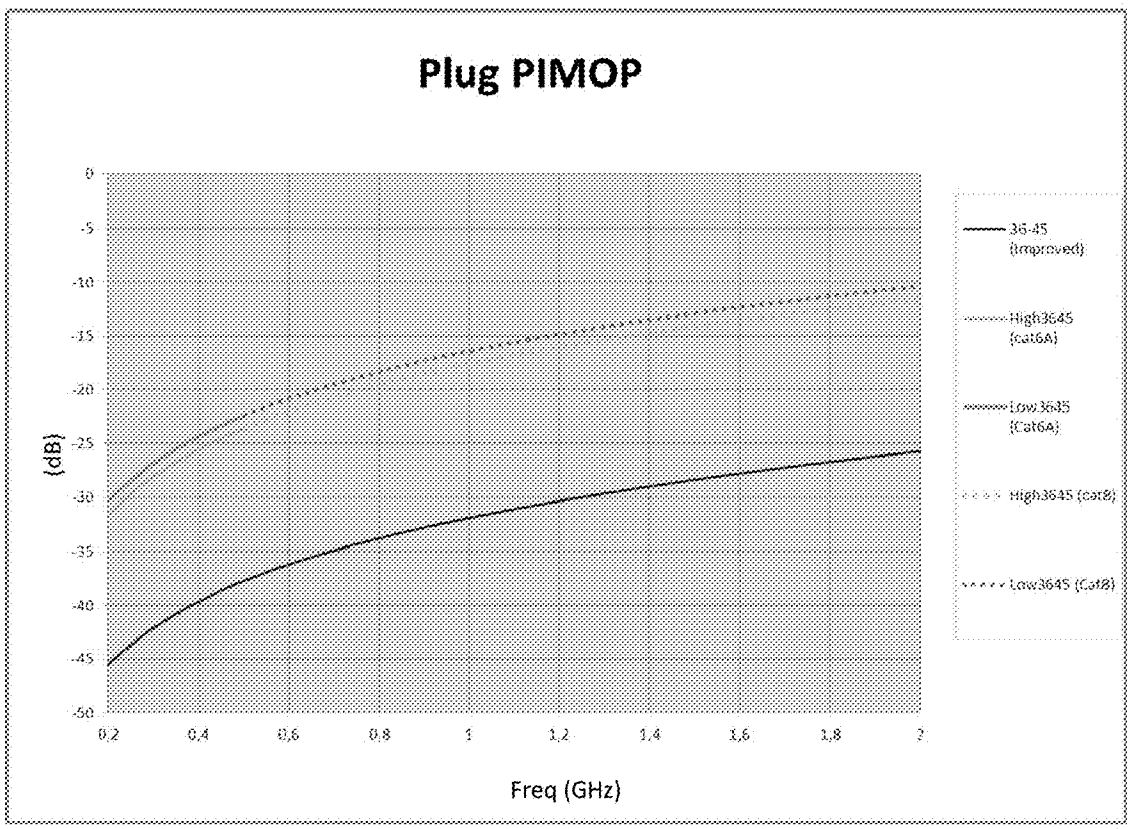
FIG. 49 is a second chart showing crosstalk performance of a telecommunications plug constructed for use in connection with high data rate telecommunications systems, according to aspects of the present disclosure.
Figure 50:
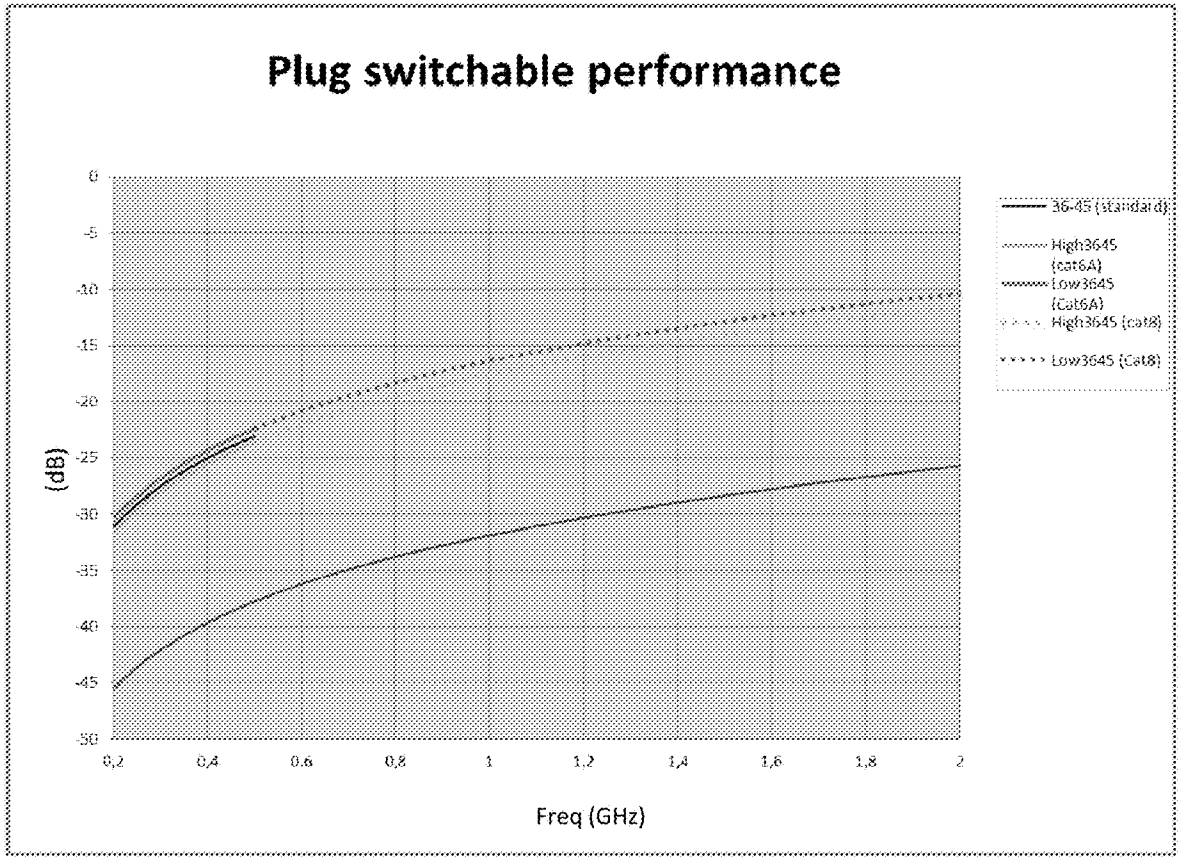
FIG. 50 is a chart showing crosstalk performance of a telecommunications plug constructed for use in connection with high data rate telecommunications systems as well as switching features for backwards compatibility with existing telecommunications systems, according to aspects of the present disclosure.

Referring now to FIGS. 48-50, charts illustrating crosstalk performance of a variety of plug types is illustrated. As seen in the charts, use of the various plug features discussed herein, in particular by selection of the PSMOP, PIMOP, or switching PIMOP variants, can allow for use of a plug with various transmission frequencies to be used in a communication network.

As seen in chart 700 of FIG. 48, a PSMOP plug performance curve is shown, in which crosstalk performance of the plug is within bounds of existing Category 6A specifications across an entire frequency range (up to about 2 GHz). It is noted that this specified performance may be inadequate for defined specifications of systems that operate in the 1-2 GHz range. However, a PIMOP plug performance curve, seen in chart 800 of FIG. 49, illustrates that such a plug, alone, designed for performance at higher data rates, would not work at lower frequencies, since it is outside of the range of acceptable performance at Category 6A frequencies (at 500 MHz and below).

Accordingly, in conjunction with the present disclosure, in FIG. 50 a chart 900 illustrates switching PIMOP plug performance, in which, at frequencies at or below 500 MHz, the plug is inserted into a standard telecommunications (e.g., RJ-45) jack, and therefore is biased toward a configuration that includes added crosstalk to cause the plug to fall within the specified performance range for such networks. However, when the plug is to be used at higher frequencies and is therefore inserted into a jack that includes a complementary switching surface, the plug can switch such that the offending crosstalk is removed from the circuit in the plug, thereby allowing the improved performance achieved by way of the various techniques above (contact designs, isolated wires, printed circuit board routing) to be exposed.

Referring to FIGS. 1-50, it is noted that the various plug designs have a variety of design variations, each of which has various advantages. For example, a plug using the techniques discussed herein to reduce crosstalk can be a simplified device, but may lack backwards compatibility to existing transmission networks and frequencies. Accordingly, a switching plug using those same techniques can be used to selectively introduce degrading crosstalk by way of capacitive couplings included on a circuit board for use across a variety of types or generations of telecommunications networks.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A telecommunications plug comprising:

a housing having an insertion portion sized to be received in a telecommunications jack; a circuit board at least partially disposed within the housing, the circuit board including a plurality of contacts exposed through the insertion portion to electrically connect to contact springs of the telecommunications jack and a plurality of wire connections receiving wires of a telecommunications cable;

a switching mechanism movable relative to the circuit board and configured to switch between first and second positions, wherein the first and second positions selectably provide capacitive crosstalk between wire pairs within the plug, wherein the plurality of wire connections includes insulation piercing contacts located at different distances from a rear edge of the circuit board and extend at different heights from the circuit board; and wherein the switching mechanism includes a chassis movable between extended and depressed positions, and biased toward the extended position.

2. The telecommunications plug of claim 1, wherein the plurality of contacts is disposed near a front portion of the circuit board.

3. The telecommunications plug of claim 2, wherein the plurality of contacts is disposed on a bottom side of the circuit board.

4. The telecommunications plug of claim 1, further comprising a chassis having a plurality of channels therethrough, each channel sized to receive a wire pair from a telecommunications cable.

5. The telecommunications plug of claim 4, wherein the chassis includes a conductive material, and wherein each channel includes an insulating insert positioned to surround a wire pair inserted into the channel.

6. The telecommunications plug of claim 1, wherein in the extended position capacitive crosstalk is connected between at least two wire pairs within the plug, and in the depressed position the capacitive crosstalk is disconnected from the at least two wire pairs.

7. The telecommunications plug of claim 1, wherein the chassis includes a contact surface positioned to be depressed by a complementary surface within a telecommunications jack.

8. The telecommunications plug of claim 1, wherein the plurality of contacts extend from the circuit board at different heights.

9. The telecommunications plug of claim 1, wherein the wire connections include insulation displacement contacts.

10. The telecommunications plug of claim 1, wherein the wire connections include soldering pads positioned on the circuit board for direct soldered connection of wires of a telecommunications cable.

11. A telecommunications plug comprising:

a circuit board installed at least partially within an insertion portion, the circuit board including an array of contacts at a first end and a plurality of wire termination contacts mounted thereon;

a wire connection portion including a chassis, the chassis including a plurality of insulating inserts separated by conductive barriers, each insulating insert having a pair of wire channels positioned therethrough, the wire channels positioned to receive wires from a telecommunications cable and aligned with the wire termination contacts;

wherein the wire termination contacts are positioned at offset positions at different distances from a rear edge of the circuit board and extend to different heights from the circuit board to reduce an amount of force required to depress the chassis toward the circuit board, and the contacts are positioned in an offset configuration thereby reducing crosstalk generated between the contacts; and wherein the wire termination contacts include at least one of insulation displacement contacts, insulation piercing contacts, and solder pads.

12. The telecommunications plug of claim 11, wherein the array of contacts includes wire contacts.

* * * * *